US008241092B1

(12) United States Patent
Lytle

(10) Patent No.: US 8,241,092 B1
(45) Date of Patent: Aug. 14, 2012

(54) MINIMAL FORCE AIR BEARING FOR LAPPING TOOL

(75) Inventor: Tracy Lytle, Camarillo, CA (US)

(73) Assignee: Veeco Instruments, Inc., Plainview, NY (US)

( * ) Notice: Subject to any disclaimer, the term of this patent is extended or adjusted under 35 U.S.C. 154(b) by 0 days.

(21) Appl. No.: 12/985,154

(22) Filed: Jan. 5, 2011

Related U.S. Application Data

(60) Division of application No. 11/744,874, filed on May 6, 2007, now Pat. No. 7,871,306, which is a continuation-in-part of application No. 11/625,634, filed on Jan. 22, 2007, now abandoned.

(51) Int. Cl.
*B24B 49/00* (2012.01)
*B24B 51/00* (2006.01)

(52) U.S. Cl. ..... 451/5; 451/10; 451/279

(58) Field of Classification Search ..... 29/603.07, 29/603.12, 603.15, 603.16; 451/5, 10, 41, 451/57, 278, 279, 286, 287, 270, 272
See application file for complete search history.

(56) References Cited

U.S. PATENT DOCUMENTS

| | | | | |
|---|---|---|---|---|
| 3,842,544 | A | 10/1974 | Paola | |
| 4,869,779 | A | 9/1989 | Acheson | |
| 5,607,340 | A * | 3/1997 | Lackey et al. | 451/5 |
| 5,620,356 | A * | 4/1997 | Lackey et al. | 451/5 |
| 5,816,899 | A | 10/1998 | Hart et al. | |
| 6,045,431 | A * | 4/2000 | Cheprasov et al. | 451/5 |
| 6,174,218 | B1 * | 1/2001 | Church et al. | 451/5 |
| 6,217,425 | B1 | 4/2001 | Shindou et al. | |
| 6,238,276 | B1 | 5/2001 | Miyazaki et al. | |
| 6,261,165 | B1 * | 7/2001 | Lackey et al. | 451/387 |
| 6,346,029 | B1 * | 2/2002 | Church et al. | 451/5 |
| 6,375,539 | B1 | 4/2002 | Sudo et al. | |
| 6,497,611 | B2 | 12/2002 | Sakurada et al. | |
| 6,604,989 | B2 | 8/2003 | Yanagida et al. | |
| 6,736,704 | B2 * | 5/2004 | Kennedy et al. | 451/28 |
| 6,872,123 | B2 | 3/2005 | Sudo et al. | |
| 6,913,509 | B2 | 7/2005 | Sone et al. | |
| 6,990,737 | B2 | 1/2006 | Zywno | |
| 2002/0016130 | A1 | 2/2002 | Nomura et al. | |

* cited by examiner

*Primary Examiner* — Timothy V Eley
(74) *Attorney, Agent, or Firm* — Wood, Herron & Evans, LLP

(57) ABSTRACT

A lapping tool for lapping a wafer section in a well controlled manner, has a head with an actuator for bending the row tool, and a force multiplier coupled between the actuator and row tool to multiply the force generated by the actuator for application of greater bending force to the row tool than can be generated by the actuator. Furthermore, at least two actuators, which are controlled together, simultaneously apply force to one force multiplier, so as to further increase bending force. The increase in available force permits the use of a row tool of a ceramic or other material that is substantially stiffer than stainless steel, such as a row tool having a coefficient of thermal expansion that is substantially similar to that of the rowbar itself. The tool further includes structures for tilting or otherwise orienting the wafer section relative to the lapping plate.

25 Claims, 23 Drawing Sheets

MINIMAL FORCE AIR BEARING FOR LAPPING TOOL

RELATED APPLICATION

This application is a divisional of U.S. application Ser. No. 11/744,874 filed May 6, 2007, which is a continuation-in-part of U.S. application Ser. No. 11/625,634 filed Jan. 22, 2007, each of which is hereby incorporated in its entirety.

FIELD OF THE INVENTION

The present invention relates to the manufacture of magnetic heads for data storage drives.

BACKGROUND OF THE INVENTION

A typical hard disk drive includes a series of magnetic disks or platens, each associated with a magnetic read/write head. The head, commonly known as a thin film head (TFH), comprises a reader and writer, is typically a monolithic device embodied within a slider. The head is formed analogous to an integrated circuit and includes magnetic elements forming magnetic write poles, a coil for generating a magnetic field for writing the disk, and magnetic sensor for reading the disk. The magnetic head is incorporated into a trailing edge of the slider. One face of the slider, known as the air bearing surface (ABS), is manufactured so as to ride on an air cushion very close to but above the hard disk surface. The ABS is polished by a series of grinding and lapping steps, to an atomic scale smoothness and planarity, so that it can be held in constant and very close proximity to the spinning surface of the hard disk. The ABS is contoured and includes etched features and cavities that enable the slider to 'fly' at a controlled and repeatable distance over the hard disk. This distance is termed the fly-height. The slider is suspended on an arm extending from a gymbal assembly in the drive, and the whole assembly is termed the head gymbal assembly (HGA). The side of the slider opposite to the ABS, known as the back side, is mounted to the arm. The spacing and position of the slider and the disk surface must be controlled to a tight tolerance to maintain the slider at a constant fly height, which is critical for accurate reading and writing of magnetic domains on the disk. Furthermore, the planarity of the head's ABS and the parallel relationship of the ABS to the head back side (the side mounted to the slider) must be tightly controlled so that the head flies above the spinning disk at the desired height across the entire ABS.

Hard disk technology continues to evolve to provide increasingly greater areal density, most recently with the transition from longitudinal magnetic recording (LMR) in which the written bit is in the plane of the disk to perpendicular magnetic recording (PMR) in which the written bit is perpendicular to the plane of the disk since the latter has greater potential density due to larger material volume per stored bit. Increasing density, however, enhances the criticality of device dimensions, and requires scaling down all dimensions associated with the head and slider.

For the manufacturing of hard disk drives of increasing areal density to be economic, variations in tolerances of the manufactured parts must be tightly controlled. One particular source of such variation is the thickness of the slider from the ABS to the back side, as variation in this thickness translates directly to variation in fly height. Low cost manufacture thus requires the thickness of slider from ABS to back to be tightly controlled.

Heads are typically fabricated in arrays on a wafer, in a grid pattern. The finished wafer is then sliced into wafer sections which are square or rectangular, and those sections are then sliced to produce rows of heads, or stacks of rows known as "rowstacks" which are subsequently sliced into individual rows. The rows are then lapped to achieve key reader and writer parameters, pattered to define the ABS topography, and encapsulated with a passivation coating before being diced to create individual sliders which may be mounted to drive mechanisms.

The shape of each slider is a function of the straightness of the row and die cuts that formed the slider, the perpendicularity and parallelism of the cut faces to each other, and the smoothness of the faces. Shape control is important because it not only sets the dimensions of the slider but also provides well-defined reference surfaces for subsequent operations such as lapping. Optical alignment is typically performed prior to each sawing/slicing step to ensure a straight cut. This involves aligning the position of the saw blade and its direction of motion relative to alignment marks (also known as fiducials) on the wafer. In addition to this initial alignment, typically sawing or slicing is feedback controlled, to ensure best alignment across a wafer section or rowstack. After sawing, the exposed surface of the wafer, which forms either the front-side or back-side of the next row (or rowstack), is ground to remove saw marks and achieve smoothness, typically using a fixed abrasive grinding wheel. Typically it is preferable to grind the back-side of the rowbar prior to slicing, rather than grinding the ABS prior to slicing, since the former establishes the principal reference surface for the head. The separated row or rowstack is then subjected to a sequence of steps to fabricate the individual sliders.

The lapping step noted above uses a lapping plate of a soft material, typically a Tin alloy such as Tin-Bismuth or Tin-Antimony. The lapping plate is typically a disc of, e.g., 16" diameter, with a hole in the middle, e.g., 4" in diameter.

The lapping plate is typically textured, such as by "soda blasting" i.e. sandblasting with baking soda, or by turning grooves into the plate using a diamond stylus.

Once plate is textured, it may be charged with abrasive from a slurry. One exemplary slurry is ethylene glycol and water containing diamond chips. Another exemplary slurry comprises an oil base with diamond chips. Depending upon the grit desired, the diamond chips typically range from 75-100 nm as the smallest size up to 1 micron as the largest size, although there is a distribution of sizes for any chosen grit. The size and morphology of the diamonds are selected based on the nature of the application.

The lapping plate is charged with diamond using a charging plate, typically a ceramic ring. The lapping plate is rotated against the ceramic ring under pressure, typically between 5-50 psi, with the diamond containing slurry between. After approximately 30-60 minutes of such rotation, the diamond chips embed in the lapping plate (and some minor abrasion of the lapping plate). The plate is then "charged" with the diamond abrasive.

Lapping plates are qualified by using an optical method to measure roughness of a specimen lapped with the plate.

The lapping process is similar to the charging process described above, but in lapping the rowbar is mounted to a row tool, typically a metal bar, which is itself mounted to a head that fine controls the position of the row tool and bar. The head then gently pushes the rowbar against the rotating lapping plate. The long axis of the rowbar, which is about 50 mm long, is typically placed in a radial direction relative to the lapping plate, and then the head supporting the rowbar sweeps from this position about an axis outside of the lapping plate, so that the rowbar moves across the lapping plate during lapping. This process helps to average the effects of grit irregularity or imperfections in the lapping plate.

In a typical lapping process for a magnetic head, the lapping plate and slurry are chosen in sequential steps of lapping, which will be known as Rough lap, Fine lap, and Kiss lap. Rough lapping uses relatively large diamonds in a slurry, and brings the slider to within one micron of straight across the ABS. Fine lapping involves relatively small diamonds in the slurry, and brings the slider to as close to straight as possible. Kiss lapping typically does not utilize any diamond in the slurry, but relies upon diamond embedded in the lapping plate only, to generate the desired surface smoothness.

A first critical dimension to be controlled in lapping is the "stripe height", which is the height of the top edge of the sensor embedded within the head. The sensor is a stack of magnetically permeable materials adjacent to a magnetized layer. The layers are stacked on edge when the slider is flying above the disk. The degree of rotation of field in the sensor's free layer depends on the amount of material in the stack—too little mass, and the magnetization in the stack saturates, too much mass, and the magnetization will not change much. Thus, the size of the PMR sensor layers, controlled by the "stripe height" is a critical dimension.

A second critical dimension to be controlled in lapping is the "throat height" or "breakpoint height", which is the distance above the air-bearing surface at which the magnetic pole tip embedded within the slider, widens from its narrowest width at the ABS as it extends from the ABS to the magnetic coil embedded within the slider. Throat height affects the concentration of magnetic field lines emerging from the pole and is optimized for best magnetic writing of domains on the disk.

To monitor and control the depth of lapping and thus the stripe height and throat height, heads typically include an electrically resistive element that extends between two external contacts on the head. By measuring the resistance between these contacts, the lapping tool may measure the amount of material that has been lapped from each head and thus control lapping. In the case of four contacts, the lapping rate for the writer and reader may be independently monitored.

While this electrical lapping guide method is useful in measuring the manner in which lapping is proceeding, there are numerous difficulties in lapping. A first difficulty is that rowbars are not perfectly flat, so even with electrically controlled lapping the lapping amount may not be controlled consistently on all sliders in a rowbar. Very low yield results from a nonflat rowbar, as nearly all of the sliders are lapped too little or too much to achieve the critical dimensions for throat height and stripe height.

One possible solution to this problem, is to provide a flexible row tool, such as of stainless steel, and provide the lapping tool's head with a means for bending the row tool (and thus the rowbar mounted to it) as lapping proceeds. By controllably bending the row tool and rowbar, the depth of lap can be at least partially equilibrated even if the rowbar is not perfectly flat.

Even with these developments, however, consistent lapping of rowbars has not been achieved. A first source of difficulty is that known lapping tools do not control bending of the row tool tightly enough to control lapping depth across an entire row bar. A second difficulty arises from the use of a flexible row tool. A flexible tool, made of material such as stainless steel, typically has a coefficient of thermal expansion that mismatches that of the rowbar. As a consequence, under temperature change (such as occurs during lapping, or during rowbar bonding which involves thermal cycling of a thermoplastic adhesive), the bar and row tool are thermally stressed as they differently expand or contract. The resulting bending of the bar and row tool exacerbates the problems discussed above. Unfortunately, a row tool that has a similar coefficient of thermal expansion as a rowbar, e.g. one made of ceramic material, is relatively stiff and is impractical for use with known lapping tools because known tools are unable to generate sufficient forces to bend a stiff row tool of this kind. A second source of difficulty is that very low and controlled lapping pressures are required to remove material controllably at an atomic (nm) scale. A third difficulty is that the angular orientation between the surface being lapped and the lapping plate must be precisely set before lapping is started to avoid the formation of facets and ensure that the read sensor and writer are lapped at similar rates.

Thus, there remain difficulties in lapping of magnetic storage heads that limit the ability to reliable create high density storage devices using known technology.

SUMMARY OF THE INVENTION

The present invention improves upon the prior art described above by providing a lapping tool for lapping a wafer section in a well controlled manner, that addresses these difficulties inherent in the prior art.

Specifically, in a first aspect, the invention features a lapping tool for lapping a row bar mounted to a row tool, the lapping tool having a head with an actuator for bending the row tool, and a force multiplier coupled between the actuator and row tool to multiply the force generated by the actuator for application of greater bending force to the row tool than can be generated by the actuator.

In a second aspect, the invention features a lapping tool for lapping a row bar mounted to a row tool, having a plurality of actuators, at least two of which are controlled together to simultaneously apply force to a common portion of the row tool for bending thereof, so as to apply greater bending force to the row tool than can be generated by a single actuator acting alone.

In specific embodiments of these aspects of the invention, the increase in forces that may be applied to the row tool, permit the use of a row tool of a ceramic or other material that is substantially stiffer than stainless steel. The resulting flexibility in selecting the row tool permits the selection of a row tool having a coefficient of thermal expansion that is substantially similar to that of the rowbar itself.

In a third, independent aspect achieved through the invention, the invention features a lapping tool for lapping a row bar mounted to a row tool, in which the row tool has a coefficient of thermal expansion that is substantially similar to that of the rowbar itself.

In the disclosed specific embodiment of this aspect of the invention, the use of force multipliers and plural actuators applying bending force to a common portion of the row tool, enables the use of a row tool of stiff materials such as ceramic.

In a fourth aspect, the invention features a lapping tool for lapping a row bar mounted to a row tool, the lapping tool having a head with a plurality of actuators for applying force to the row tool or a portion thereof, and a plurality of load cells each respectively positioned between the a respective actuator and the row tool, measuring force applied by each respective actuator.

In specific embodiments of this aspect, the load cell is a strain gauge, and the actuators comprise voice coils applying force to the row to at two locations thereof so as to control the lapping rate across the row bar.

In a related aspect, the invention features a method for calibrating a lapping tool that includes an actuator for applying force to the row tool, and a load cell positioned between the actuator and the row tool. As the deflection of the actuator is varied, the force imparted by the actuator is detected. The relationship of the applied force and resulting deflection is then analyzed to identify operating regions of the lapping tool, the first operating region being characterized by a first incremental increase of force for a given incremental deflection, and the second operating region being characterized by a second, larger incremental increase of force for a given incremental deflection. Deflections and actuator forces in first operating region are then taken to correspond to operation when the row tool is not in contact with the lapping plate, and the second operating region corresponding to deflection of the row tool when the row tool is in contact with the lapping plate, and a deflection and force at the boundary between said first and second operating regions is taken to correspond to zero lapping force.

In specific embodiments of this aspect, the extent of the first region is used as a measure of wear of wear pads in the lapping tool, and the method further comprises identifying the need for wear pad replacement upon the detection of a first operating region spanning less than a predetermined range of deflections of the row tool.

In a fifth aspect, the invention features a lapping tool for lapping a row bar mounted to a row tool, the lapping tool having a lapping plate and fluid (for example air) bearing for supporting the lapping tool with a well-controlled downward force at a reference distance above the lapping plate.

In specific embodiments of this aspect, the fluid bearing comprises a supply of air coupled to a housing incorporating a porous media that is positioned adjacent to the lapping plate, such that air from the air supply flows through the porous media and into the space between the porous media to support the lapping tool above the lapping plate.

In a sixth aspect, the invention features control system for a lapping tool utilizing a fluid bearing. The control system is utilized to adjust the fluid supply to the fluid bearing in contact with the lapping plate at a near zero normal force, thus providing the stability and stiffness of a wear pad and the reduction of wear of an air bearing.

In specific embodiments of this aspect, the fluid bearing is made of a conductive material and the control system measures electrical connectivity between the fluid bearing and the lapping plate, utilizing this controlled variable to adjust the air or other fluid supplied to the bearing and thus control the normal force of the fluid bearing to a near zero value.

The above and other objects and advantages of the present invention shall be made apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
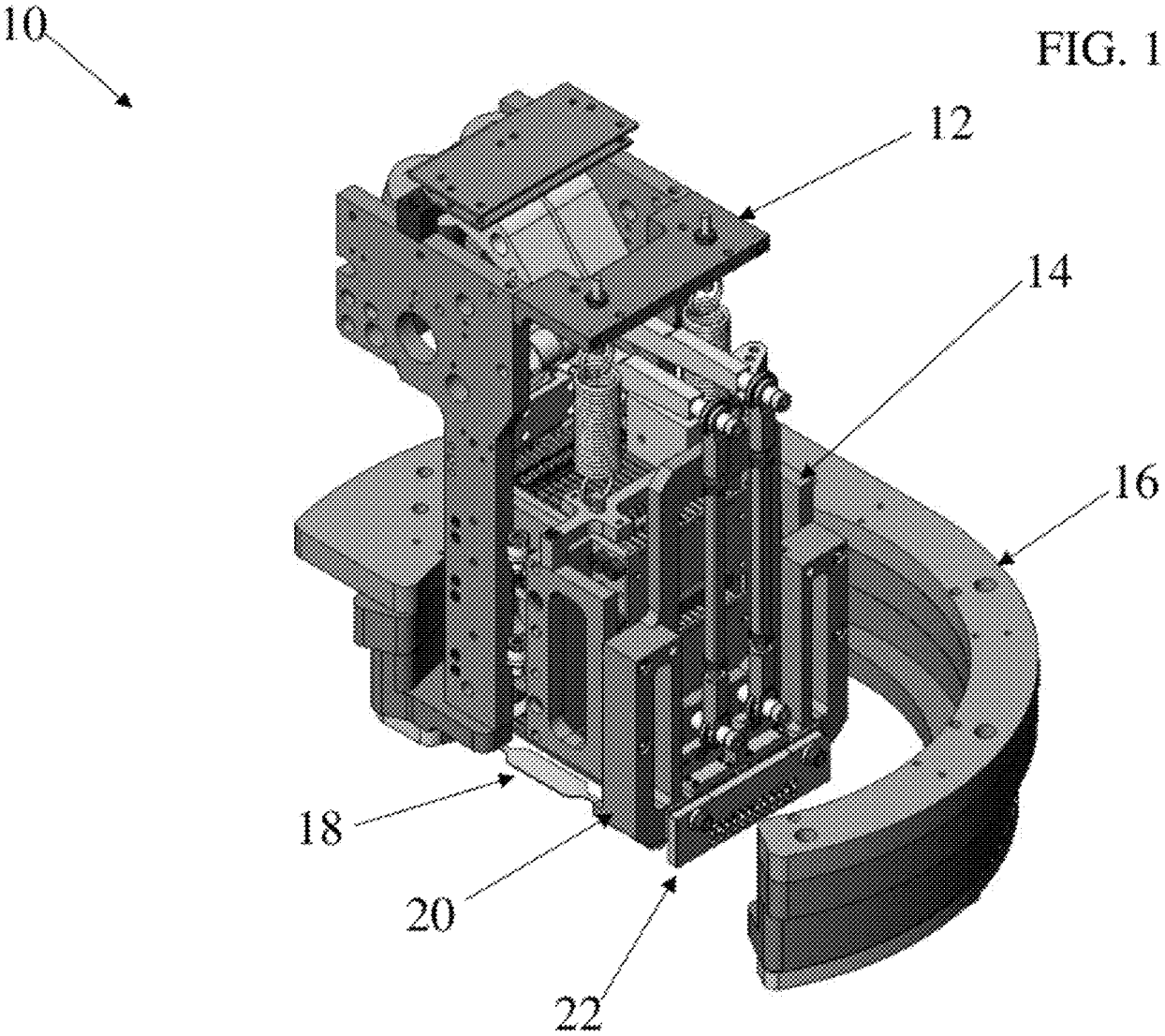
FIG. 1 illustrates the relationship between the various parts of the head assembly.

FIG. 1 is an isometric projection of a head assembly 10 in accordance with principles of the present invention. The figure illustrates the relationship between the various parts of the head assembly 10. The head assembly 10 consists of a fixed head assembly 12, a floating head assembly 14, and a boomerang assembly 16. Also shown is the front plate assembly 20, which is part of the floating head assembly 14.

Figure 2A:
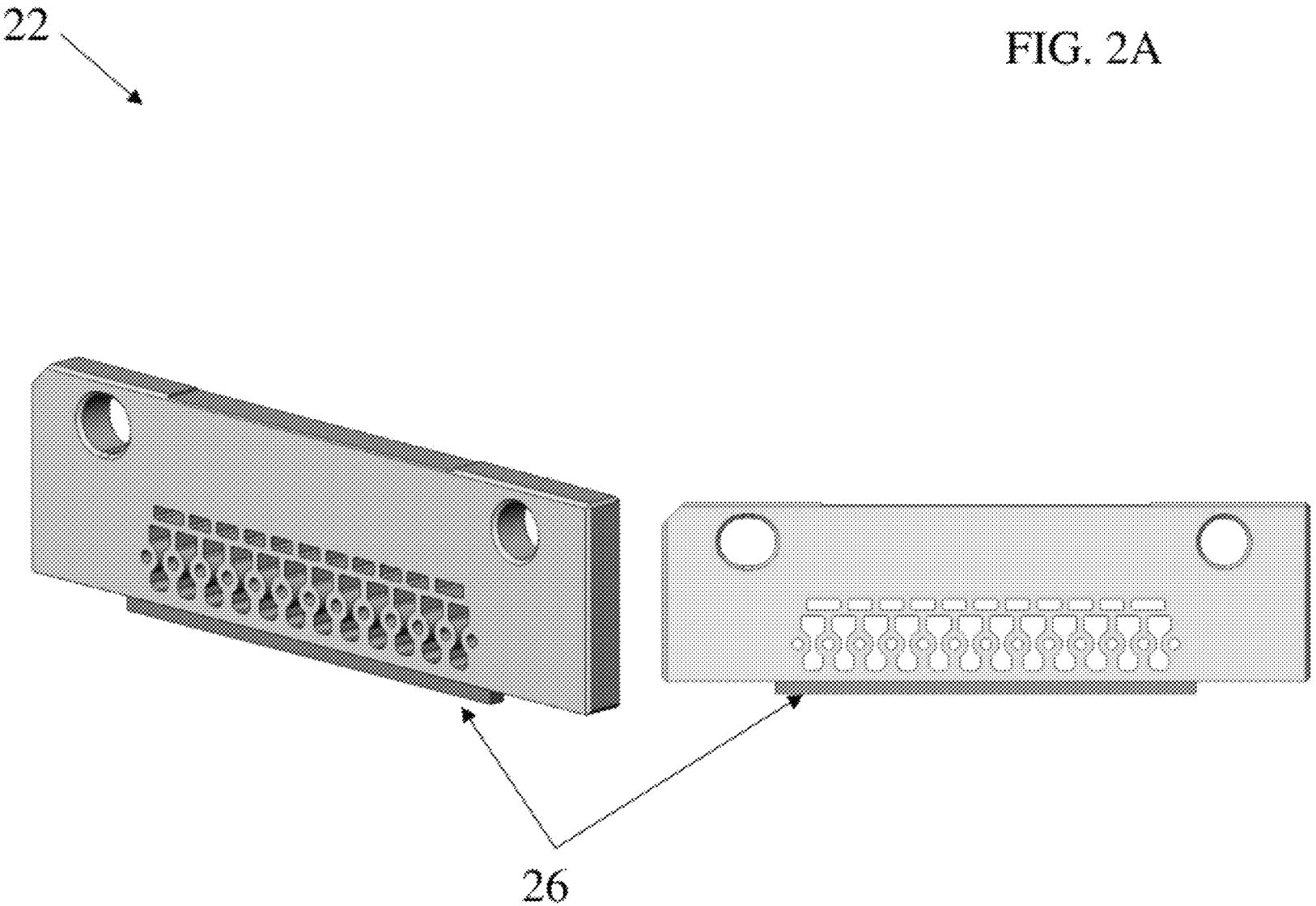
FIGS. 2A-B illustrates two row tool embodiments using different types of material.
Figure 2B:
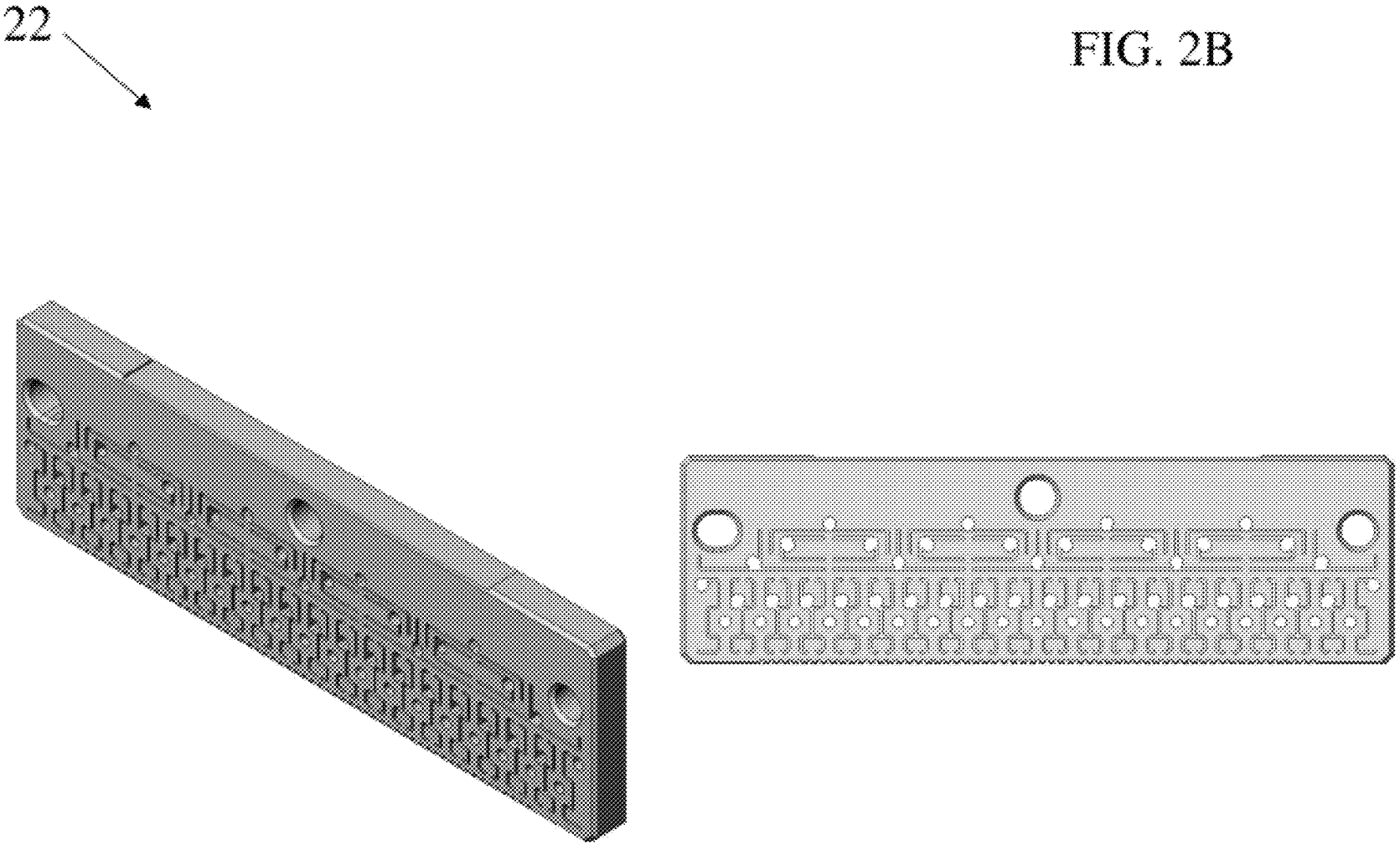

Referring now to FIGS. 2A and 2B, examples of two possible material types of a row tool 22 are shown. FIG. 2A illustrates a ceramic embodiment of a row tool 22, the location of the row 26 with respect to the row tool should be noted. FIG. 2B illustrates a stainless steel embodiment of the row tool 22. The rowbar comprising a number of sliders (not shown in FIG. 2B) is attached at roughly the same location as the row 26 was attached in the ceramic embodiment. Also, the stainless steel embodiment incorporates grooves in the location of the point of row 12 attachment. These allow a dicing tool to dice the row 12 while still affixed to the row tool 10 in those manufacturing systems that use such a method. There are two larger holes in the ceramic embodiment, and the three larger holes in the stainless steel embodiment. These holes permit precise alignment and attachment of row tool 22 to a front plate assembly 20. The various cut outs, other than the previously mentioned holes, on both embodiments are for the purpose of adding flexibility to the row tool 22. It should be noted that the cut outs on both embodiments form a repeating pattern, each pattern section can correspond to a point of applied force. It should be noted that the stainless steel row tool is more flexible than the ceramic row tool. This translates to a greater fraction of force transferred to specific points on the row 12. That being said, the stainless steel embodiment tends to facilitate more points for applying pressure. It should also be noted that material properties, i.e. coefficient of thermal expansion, play a part in the selection of material to be used in the row tool 10. Ideally, the coefficient of thermal expansion for the row tool 10 should match that of the row 12. A row tool 10 can be made of any material which best facilitates the needs of the specific embodiment.

Figure 3:
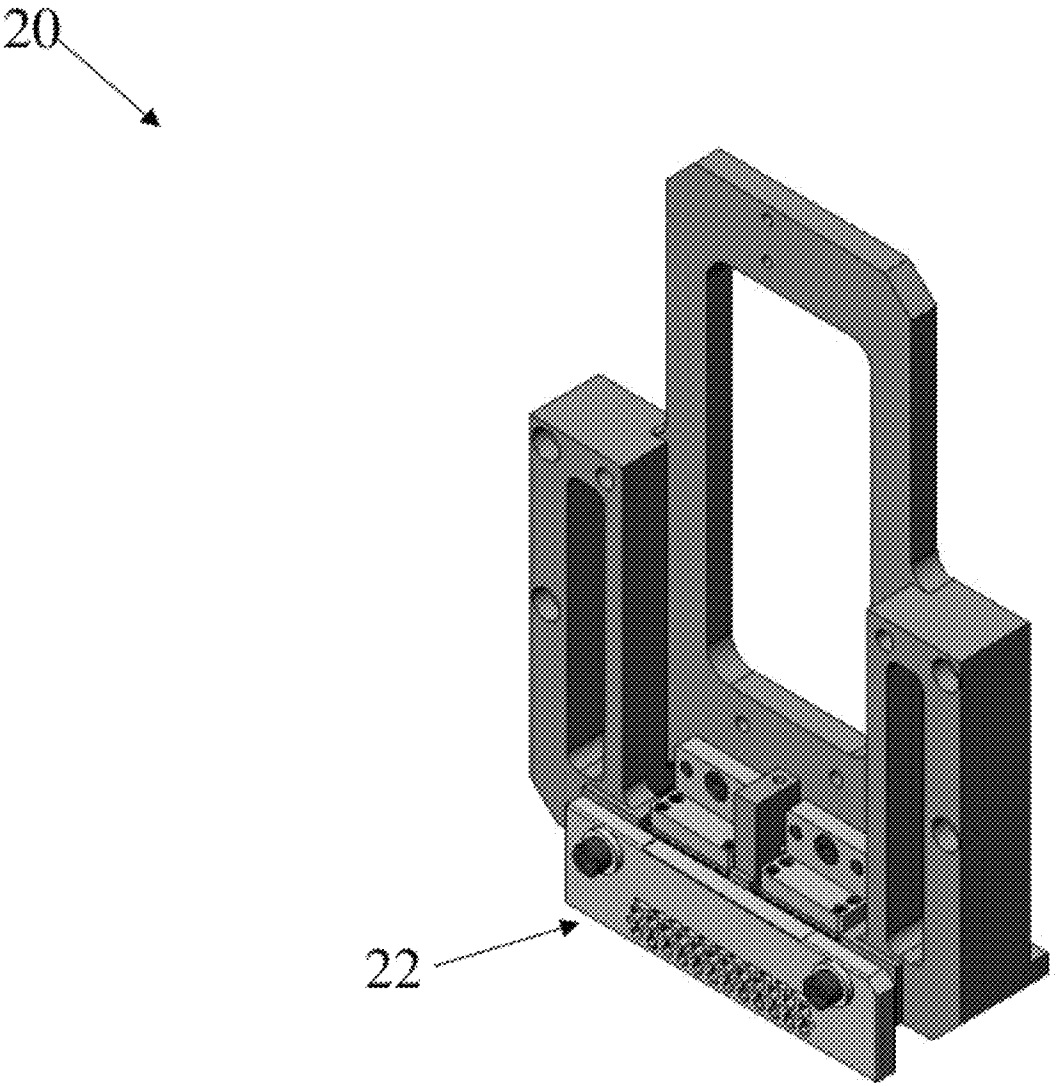
FIG. 3 illustrates the attachment location of the row tool to the front plate assembly.

FIG. 3 is an isometric projection of a front plate assembly 20. This figure illustrates the relationship between the row tool 22 and the front plate assembly 20. As mentioned previously, the larger holes on the row tool 22 are for the purpose of precisely aligning and attaching the row tool 22 to the front plate assembly 20. This can be done using any suitable sort of attachment medium, such as a machine screw, bolt, or rivet.

Figure 4A:
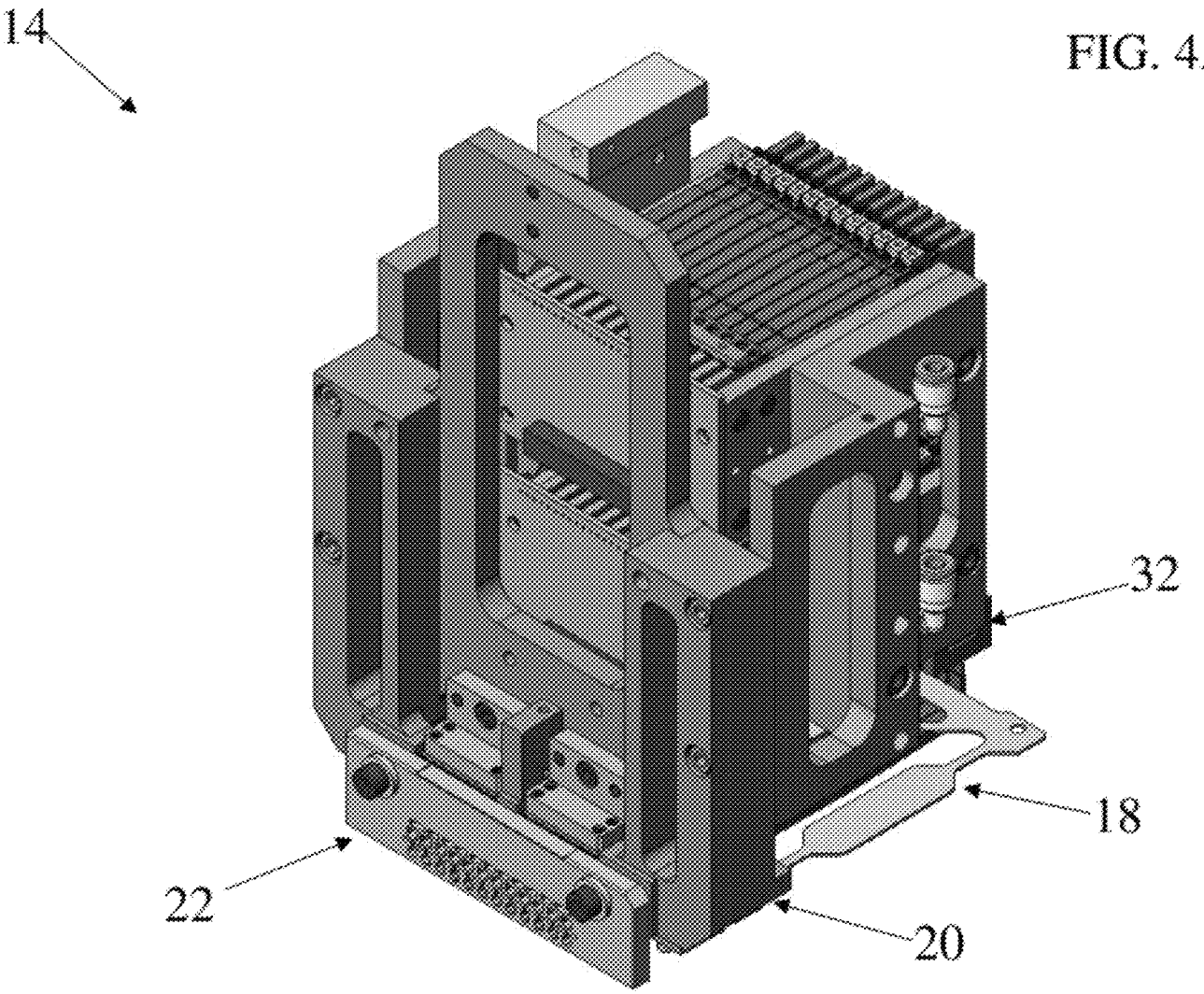
FIGS. 4A-C illustrates three views of the floating head assembly.
Figure 4B:
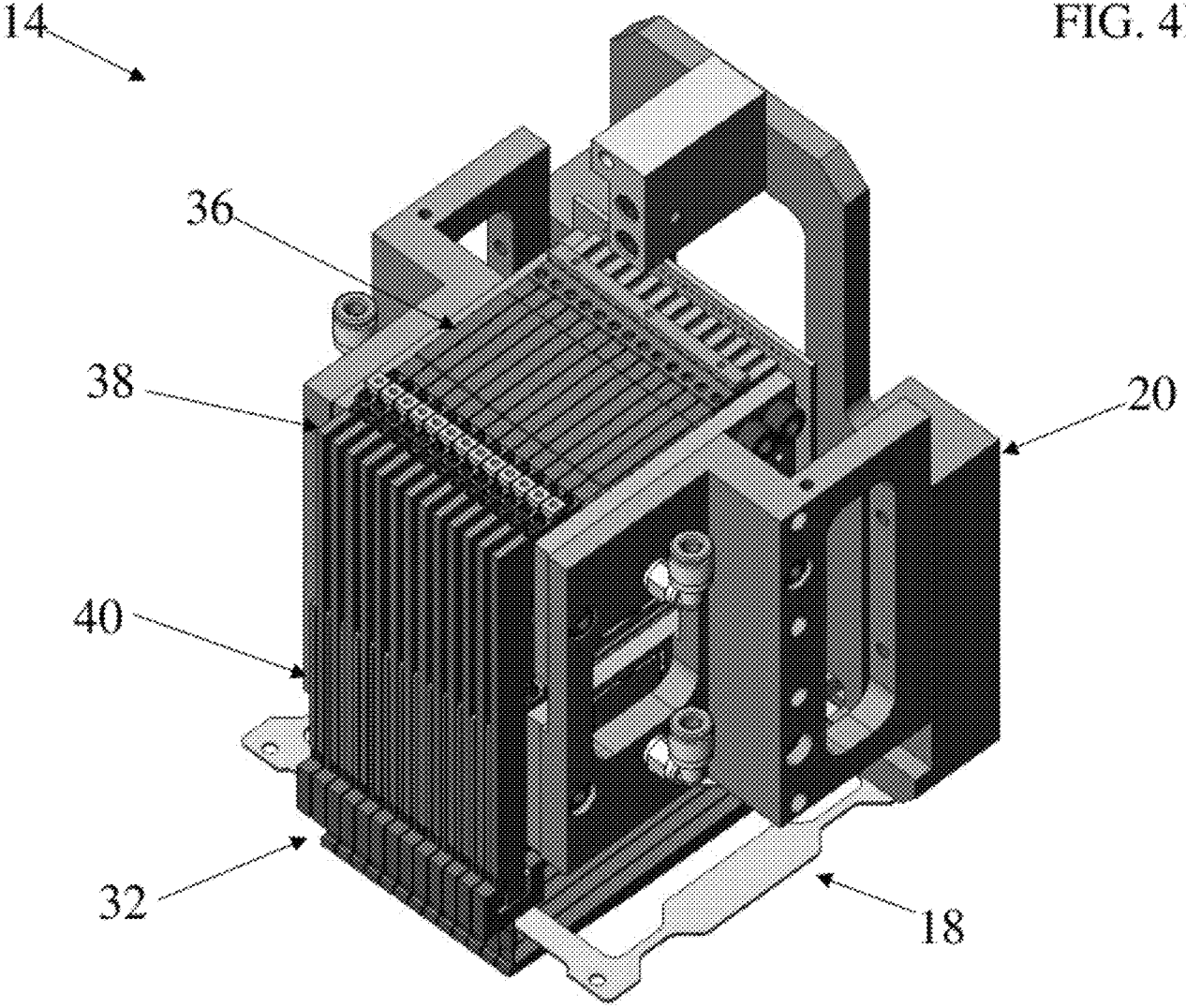
Figure 4C:
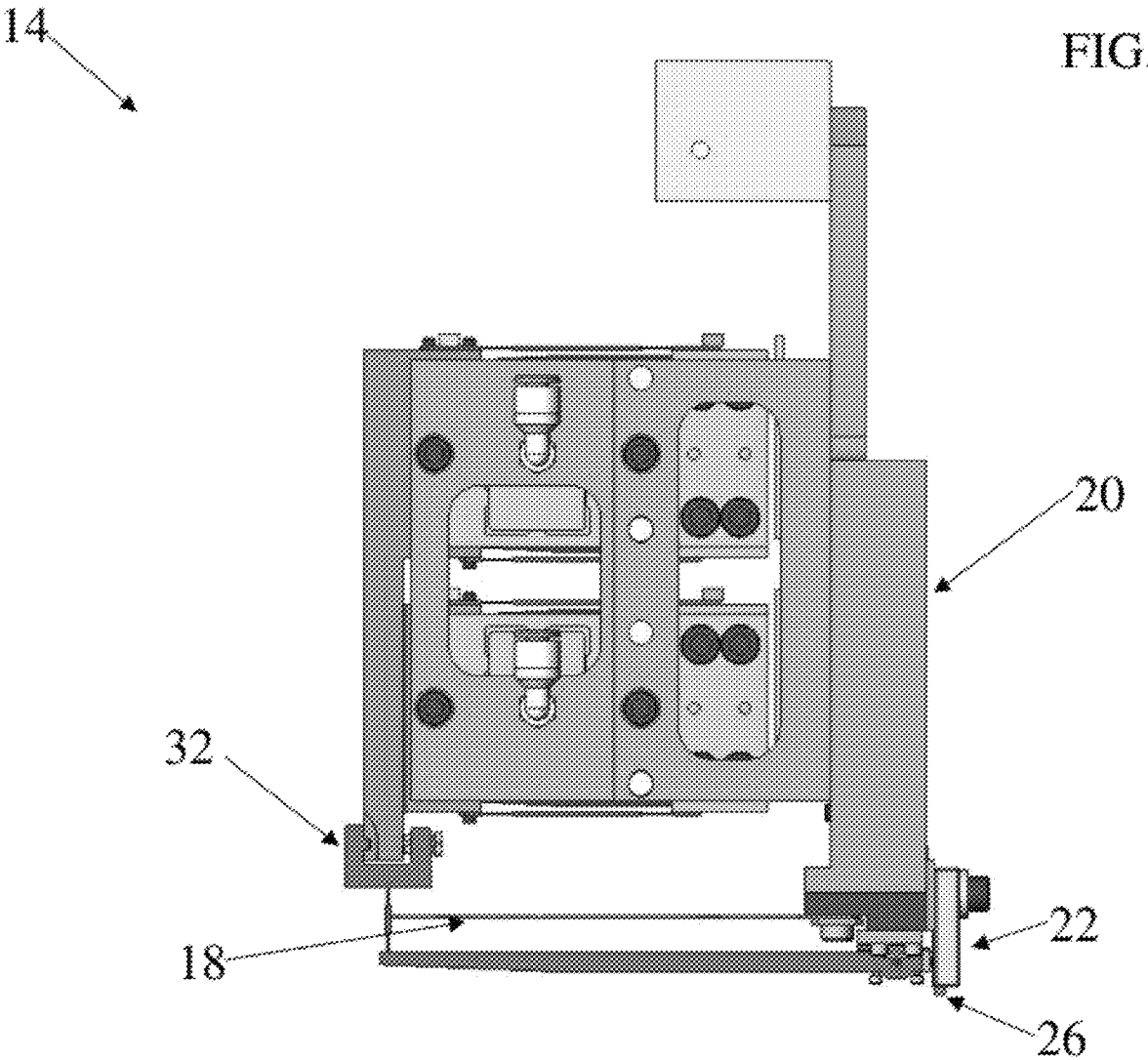

FIGS. 4A-C illustrates a floating head assembly 14, FIGS. 4A and 4B are isometric projections, and FIG. 4C is an orthographic projection. Referring now to FIG. 4A, the relative position of the front plate assembly 20 within the floating head assembly is shown. A bottom flexure 18 attaches the floating head assembly 14 to the boomerang assembly 16. This flexure enables the floating head assembly 14 to "float" above the lapping plate while being relatively constrained in the x-y plane. FIG. 4B illustrates the floating head assembly 14 of FIG. 4A, shown from a reverse angle. This angle enables the view of several components of the floating head assembly 14 which were not seen in the previous figure, namely a force multiplier 32, a flexure 36, a long flag assembly 38, and a short flag assembly 40. The location of the front plate assembly 20 should be noted, as well as the bottom flexure 18. The long flag assembly 38 and the short flag assembly 40 work together to apply force at specific points. The force multiplier 32 supplements the force applied by the flag assemblies, as the flag assemblies may not generate the necessary amount of force. The flexures 36 hold the flag assemblies in a neutral position, and facilitate the return to the neutral position upon completion of the application of a force.

FIG. 4C illustrates the force multiplier 42, and its position within the floating head assembly 14. The force multiplier 42 is attached to long flag assembly 38 and short flag assembly 40 to apply the necessary amount of force required to bend the row tool 22 and thus the row 26. The force multiplier 42 may, in one embodiment, have a 10:1 work ratio to apply the needed force. The front plate assembly 20 and the bottom flexure 34 are shown for orientation purposes.

Figure 5:
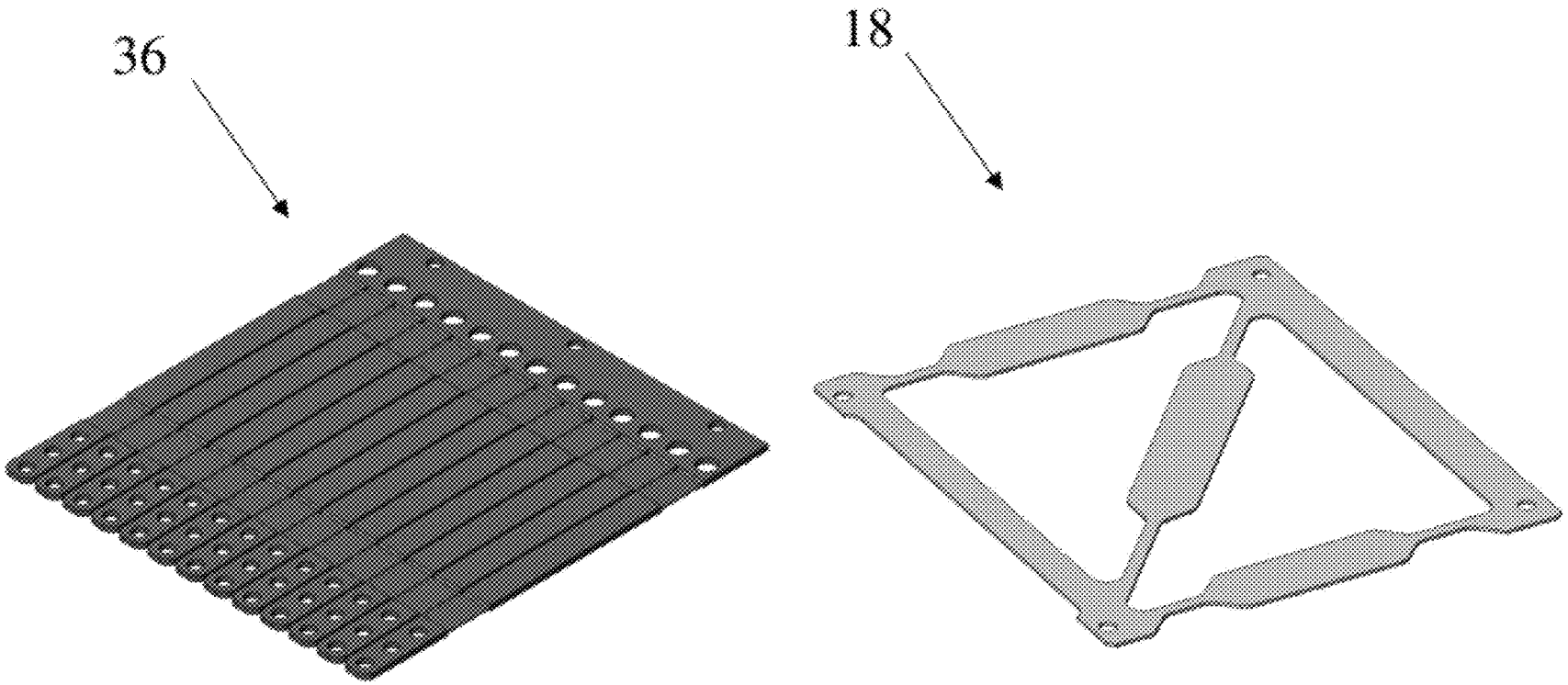
FIG. 5 illustrates the two types of flexures.

FIG. 5 is an isometric projection of the flexure 36 and the bottom flexure 34. It should be noted that the flexure 36 is divided into many segments to facilitate the movement of the individual flag assemblies. Three holes in the back of the flexure 36 attach the wire guide to the flag assembly. Thirteen larger holes facilitate attachment of the flexure 36 to the rear of the flag assemblies, whereas the thirteen groups of three holes facilitate the attachment of the flexure 36 to the front of the flag assemblies individually. Again, this provides the ability for the flag assemblies to move independently of each other. The four holes on the bottom flexure 34 correspond to attachment points, two for the attachment of the bottom flexure 34 to the boomerang assembly 16, and two for the attachment of the bottom flexure 34 to the floating head assembly 14. Again, this enables the floating head assembly to "float" above the lapping plate.

Figure 6:
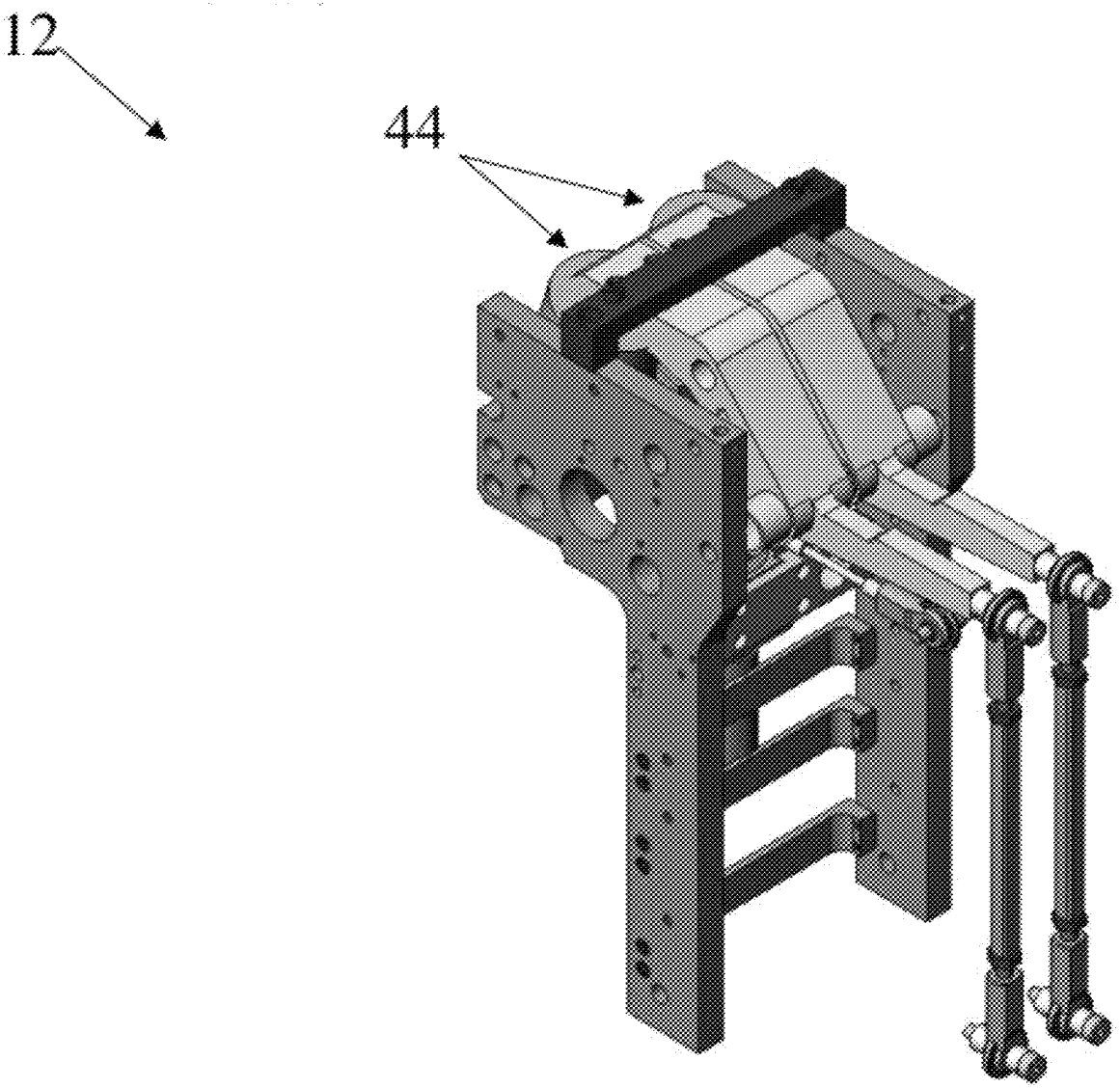
FIG. 6 illustrates the fixed head assembly and the location of the voice coil actuators.

FIG. 6 is an isometric projection of the fixed head assembly 12, illustrating the voice coil actuators 44. There are two such actuators, attached to a series of levers (not shown), which in turn attach to the floating head assembly 14. The voices coil actuators 44 aid in applying an overall lapping force. If both actuators are utilized then an overall force is applied to the floating head assembly 14, which in turn applies an overall force to the row tool 22. The voice coil actuators 44 can also be used independently to apply a side-to-side force differential depending on what is needed. This can be used to induce a differential in lapping rates one end of the rowbar relative to the other end.

Figure 7A:
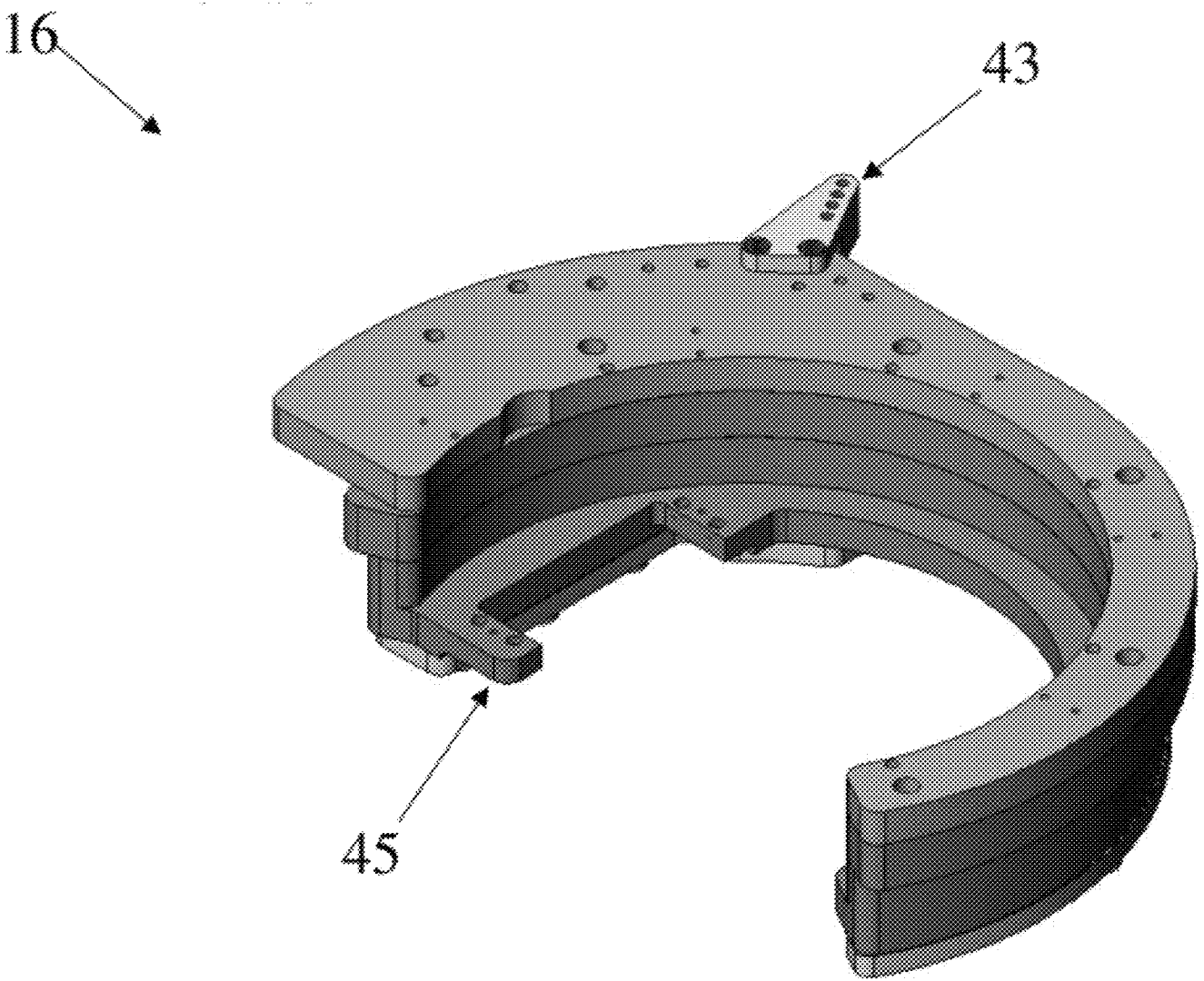
FIGS. 7A-B illustrates the boomerang assembly and the position of the wear pad assembly.
Figure 7B:
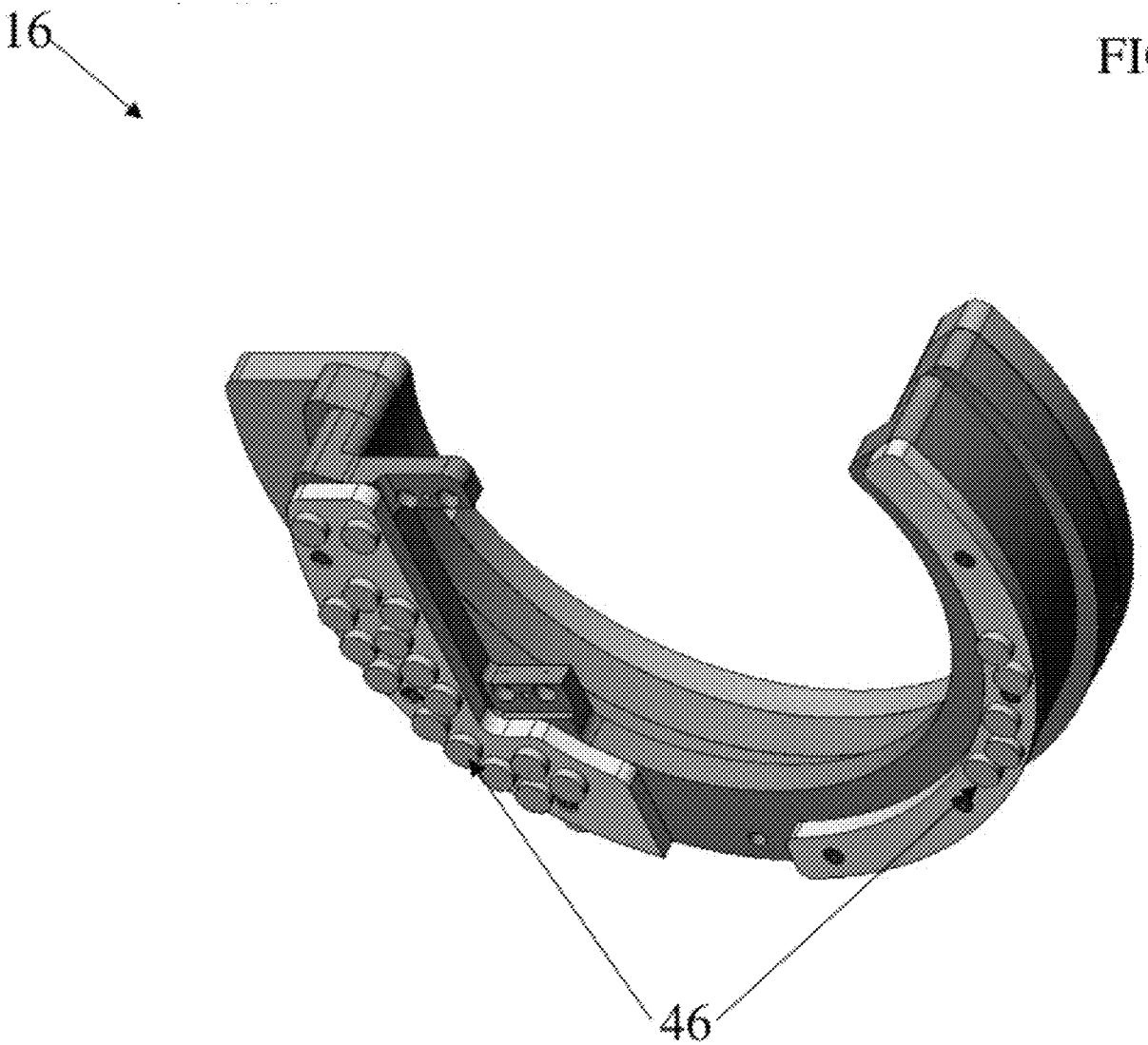

FIGS. 7A and 7B are isometric projections of the boomerang assembly 16. FIG. 7A is a top view, which depicts the various attachment locations, including attachment point 45 for the fixed head assembly 12 and bottom flexure 18. Also, there is an attachment point 43 for the pivot arm. The other various holes around the perimeter of the boomerang assembly 16 are for attachment to a flexure to which the boomerang assembly 16 is mounted to the remainder of the lapping machine.

FIG. 7B illustrates a wear pad assembly 46. Wear pad assembly 46 and the boomerang assembly 16 as a whole, establish a reference datum with respect to the lapping plate, by which the floating head assembly 14 can accurately position the row tool 22 and conversely the row 26 on to the lapping plate. The wear pad assembly 46 can be made using any material that facilitates the specific needs of the particular embodiment, i.e. aluminum or ceramic. Wear pad assemblies 46 are removable and may be replaced after they have worn excessively, or may be substituted with hydrostatic bearings as described in greater detail below.

Figure 8A:
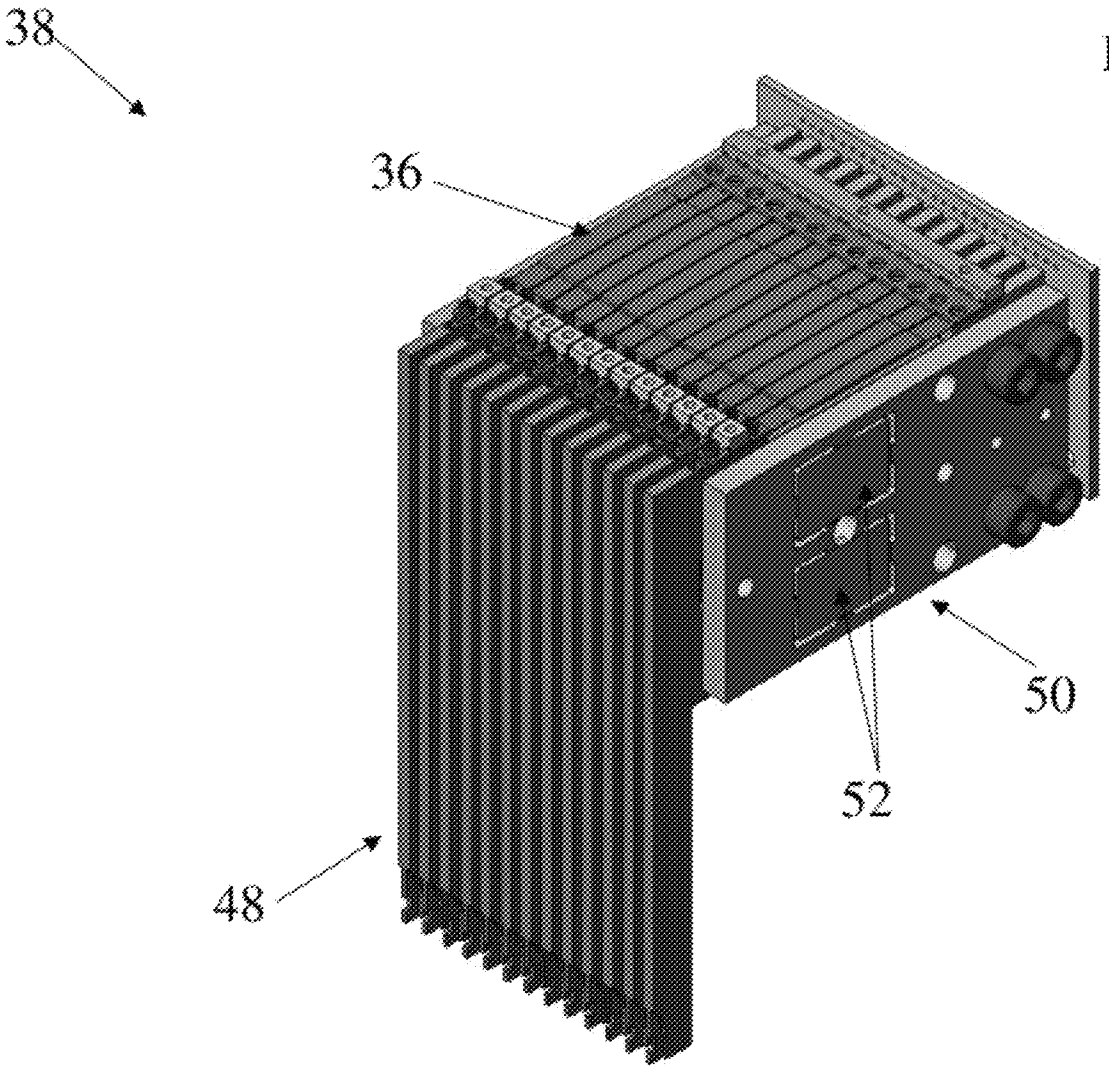
FIGS. 8A-D illustrates the flag actuator assemblies for both the long flag and short flag assembly.

Referring now to FIGS. 8A through 8D, several isometric projections illustrate the long flag assembly 38, the short flag assembly 40, as well as the end plate assembly 50. FIG. 8A illustrates the long flag assembly, it should be noted that the long flag assembly 38 is composed of a plurality of long flag actuators 48, each of which are independent of each other. On either side of the long flag assembly 38 are the end plate assemblies 50. Each end plate assembly contains two magnets 52. The purpose of the magnets is to create a magnetic field, which interacts with the copper coils 56 (see FIG. 8C) located within each actuator. This magnetic field drives the individual actuators in alternate directions, based upon the direction of current present through the copper coil 56 within the individual actuator. Again, the purpose of the flexure 36 is to maintain a neutral flag actuator position.

Figure 8B:
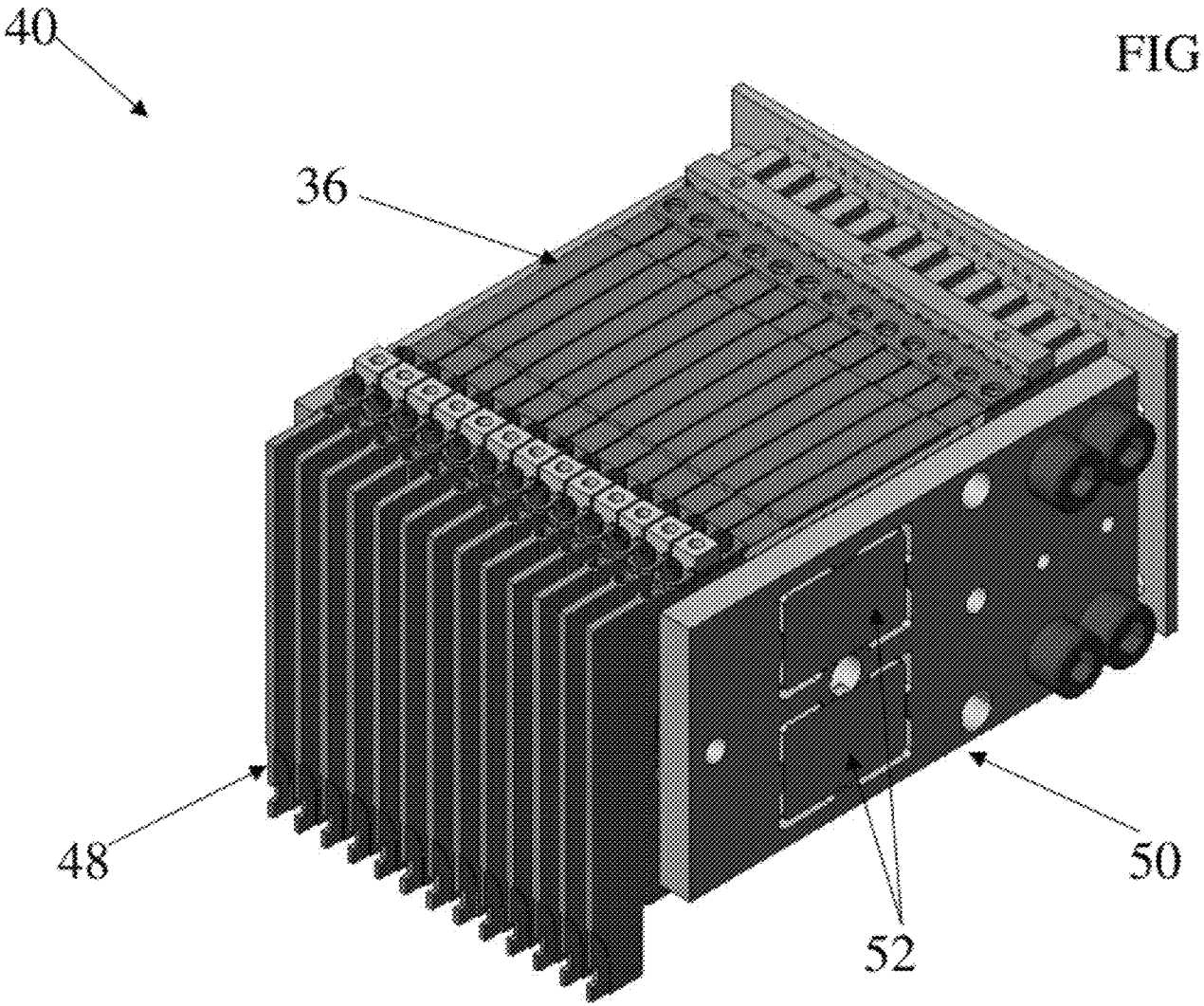

FIG. 8B shows the short flag assembly; the functionality of the short flag assembly is similar to that of the long flag actuator. When placed together the long flag assembly and the short flag assembly work together to apply the necessary point force. Individually, a long flag actuator or a short flag actuator may not generate the necessary force to apply the required pressure to the end of a force multiplier 32 as shown in FIGS. 4B and 4C. Therefore, in accordance with principles of the present invention, a pair of such actuators is utilized to generate the required force. It should be noted that one long flag actuator and one short flag actuator constitute a pair. The long flag actuator 48 does not act independently of the short flag actuator 54 counterpart. However, each long flag actuator-short flag actuator pair can act independently of other long flag actuator-short flag actuator pairs. It should be noted that the need to pair flag actuators is only necessary when the row tool 22 is made of a material having a stiffness requiring a greater amount of force. For example, a ceramic row tool is much stiffer than a stainless steel row tool, therefore more force will be required to apply the necessary pressure to the row 26 when row tool 22 is of ceramic material. A stainless steel row tool embodiment may not require a pairing of flag actuators; therefore, by the inclusion of additional force multipliers, the number of pressure points on a stainless steel row tool 22 may be made will be twice that of a ceramic tool.

Figure 8C:
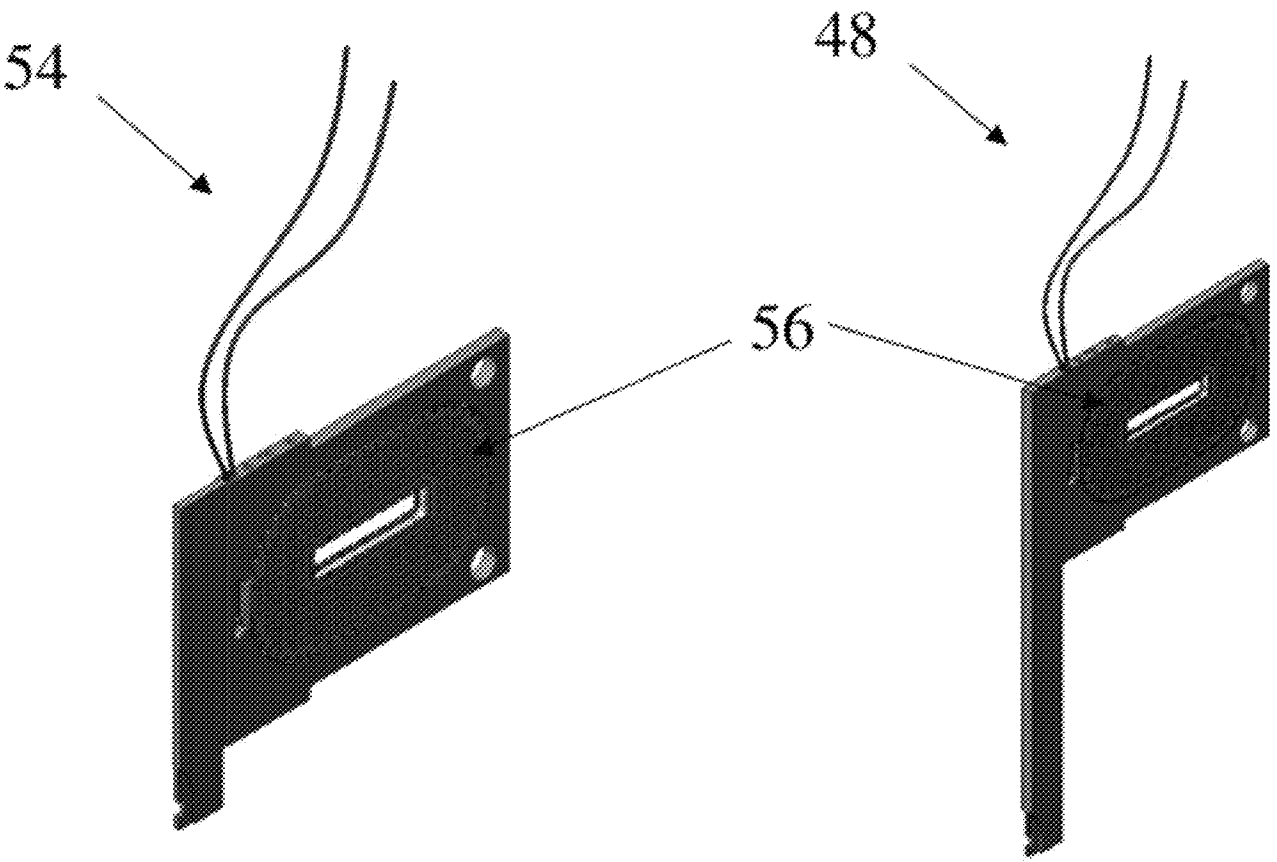
Figure 8D:
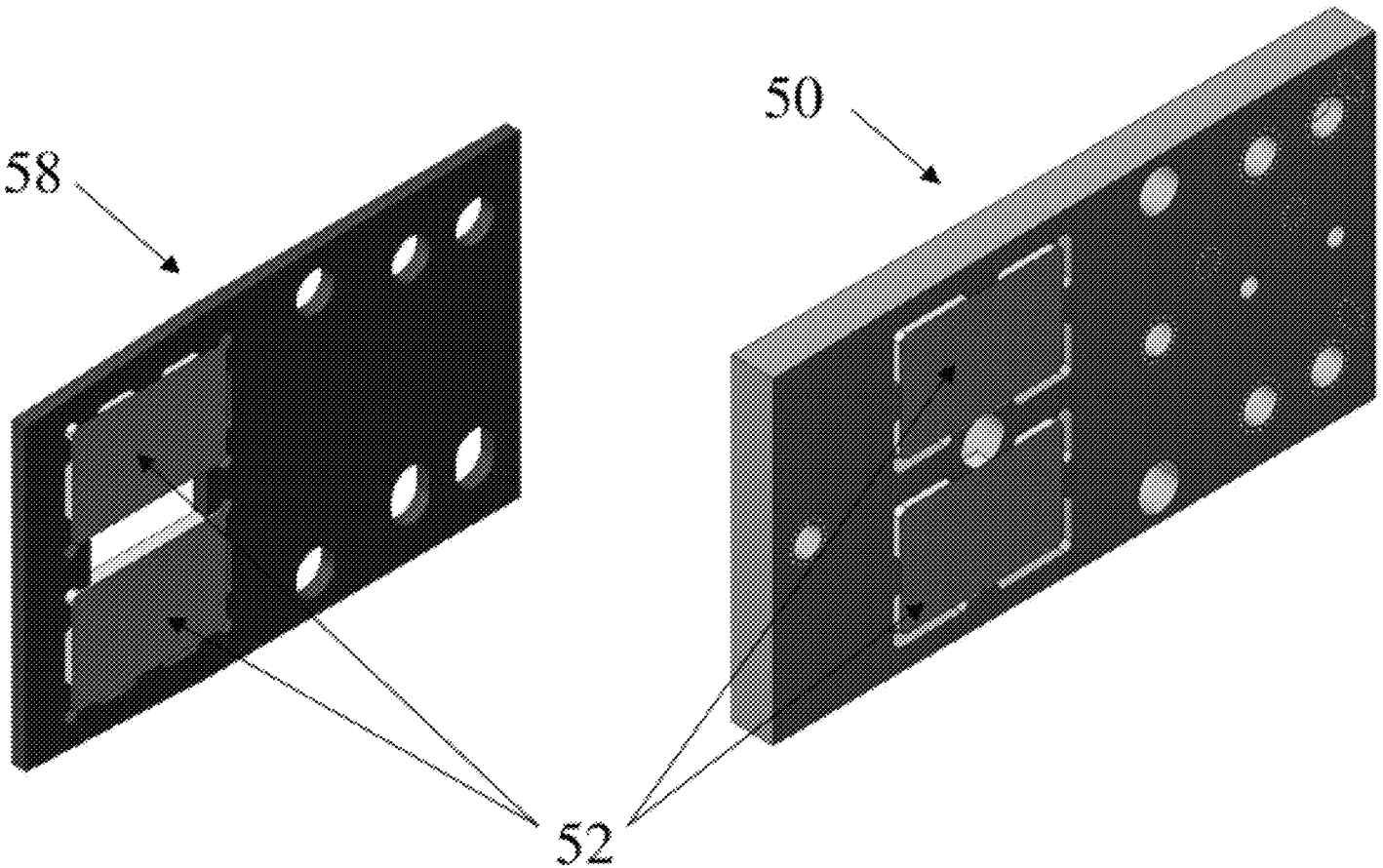

FIG. 8C illustrates the location of the copper coils 56 within the long flag actuator 48 and the short flag actuator 54. As noted before, when a current is present in the copper coils 56 the magnetic field induced by the magnets 52 cause the actuator to move in a direction consistent with the right hand rule for an electric field within a magnetic field. FIG. 8D is an illustration of the magnetic plate assembly 58 and the end-plate assembly 50, note the locations of the magnets 52 relative to the assembly.

Figure 9A:
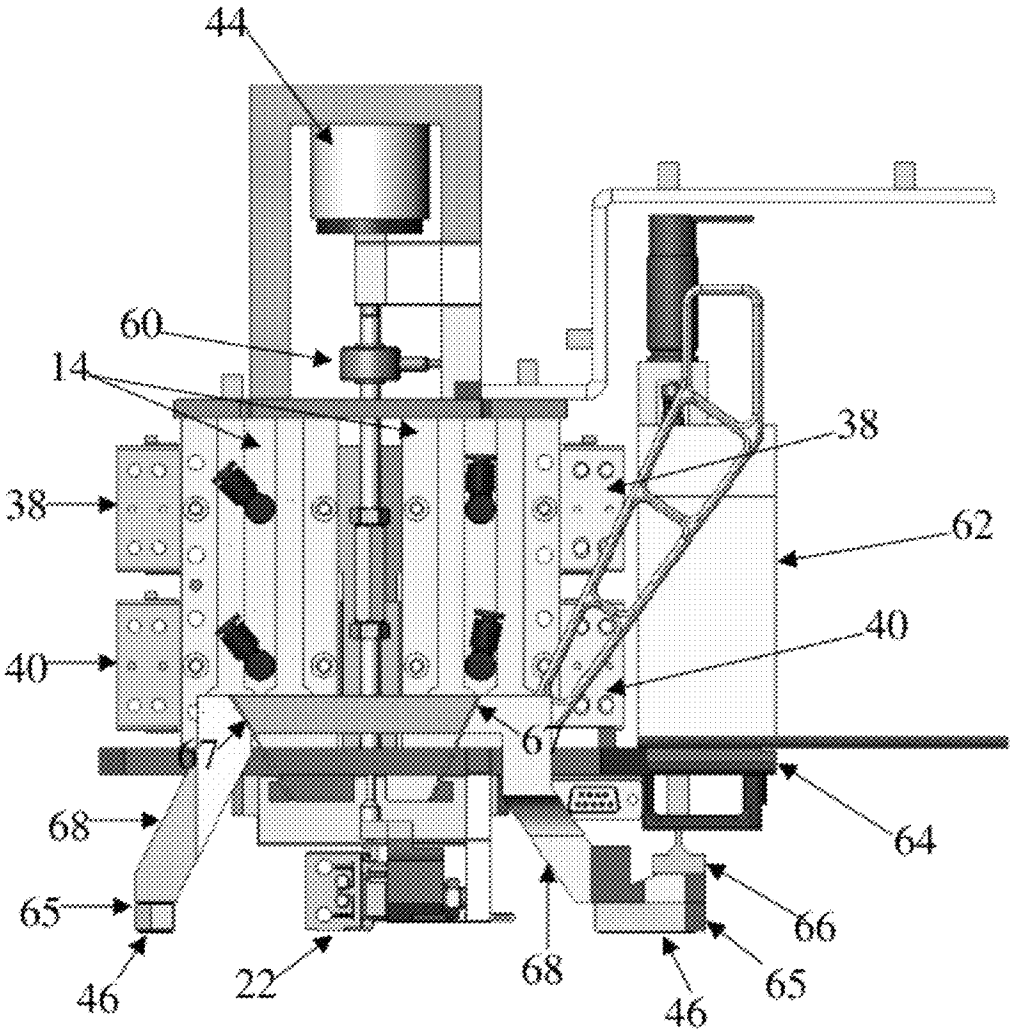
FIGS. 9A-D illustrates a further embodiment on the present invention.

Referring now to FIGS. 9A-9D, an additional embodiment of the present invention is represented. As illustrated by FIG. 9A this particular embodiment makes use of two floating head assemblies 14 that make contact to the row tool 22 directly. It should be noted that this particular embodiment does not make use of a force multiplier 32. This embodiment contains double the amount of flag actuators, thus enabling greater force to be applied to a certain pressure point, or the addition of more force points. This embodiment makes use of a strain gauge 60 located between the voice coil actuators 44 and the point of voice coil actuator applied force, this can allow for feedback on the amount of force applied. It should be noted that strain gauges could also be used in conjunction with the individual flag actuators to enable more detailed feedback.

Because the strain gauge is positioned between the actuator and the row tool, it may be used for calibration purposes. Specifically, as the deflection of the actuator is varied, the force imparted by the actuator can be detected. The relationship of the applied force and resulting deflection can then be analyzed to identify the regions of operation in which the row tool is and is not contacting the lapping plate. Specifically, a given incremental increase of force will create a greater incremental deflection when the row is not in contact with the plate than when the row is in contact. In the noncontact region, the relationship between force and deflection will be roughly linear at a first slope, and in the contact region the relationship will be roughly linear with a second, greater slope. The intersection of these two roughly linear regions is the point at which the row makes contact with zero normal force. Furthermore, the extent of deflection that can be accomplished at the first, lower slope is a measure of the remaining thickness of the wear pads; if the wear pads are very worn only a small range of deflection will be observed at the lower slope. If the range of deflection at the lower slope is below a threshold, then the operator may be notified that the wear pads are worn and should be replaced.

The wear pad assemblies 46 connect to a wear pad assembly block 65, which can contain one or more wear pad assemblies. The wear pad assembly block is attached to the wear pad assembly frame 68. The wear pad assembly frame 68 connects to the floating head assembly 14 via a wedge flexure 69 (see FIG. 9B). There are two wedge flexures 69, one on either side of the row tool, and the angle of the wedge flexures 69 is such that a virtual pivot point is created at the center of the row 26, this allows for a rotation about the row 26 center. The wedge actuator assembly 62 applies a downward force via the wedge actuator flexure 66, which in turn applies a force to the wear pad assembly frame 68. The resulting force pivots the head assembly 14 relative to the main plate 64 to adjust wedge angle of the rowbar bonded to the row tool, thus allowing accurate lapping to the desired throat and stripe height as detected by reference to the electrical lapping guide system. It should be noted that this embodiment could make use of a contact less, wear-free, load support in place of the wear pad assembly, i.e. an hydrostatic bearing surface which would utilize a porous media hydrostatic bearing assembly. FIG. 9A is shown without the two row tool clamps, which will be illustrated in further figures.

Figure 9B:
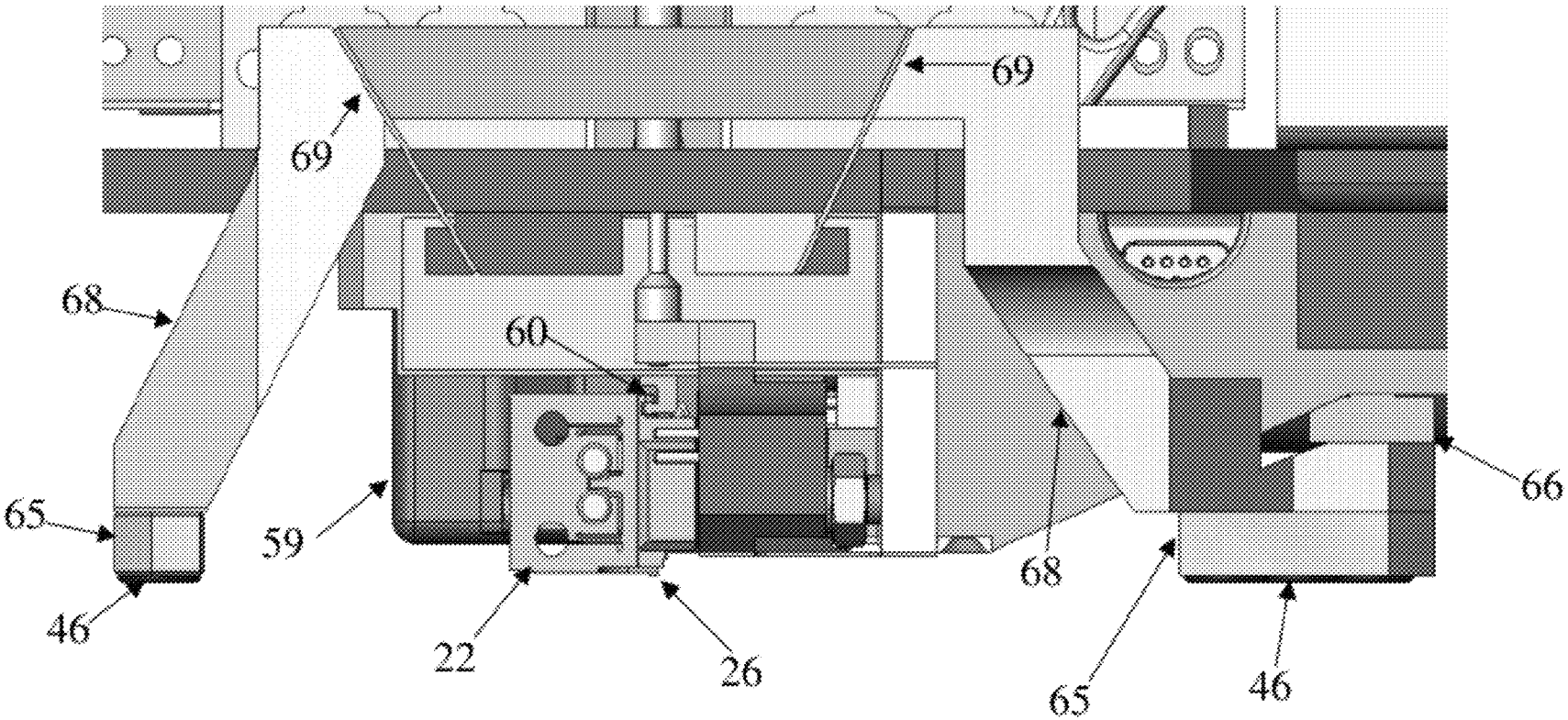

FIG. 9B is a closer illustration of the area surrounding the row tool 22. The point 60 at which the flag actuators make contact with the row tool 22 should be noted. The "c" shape enables both downward and upward pressure to be applied to the row 26. One of the two row tool clamps 59 is shown in this figure, the front side clamp has been omitted for the purposes of clarity. Note the two wedge flexures 69, and their relative positions with respect to the row tool 22.

Figure 9C:
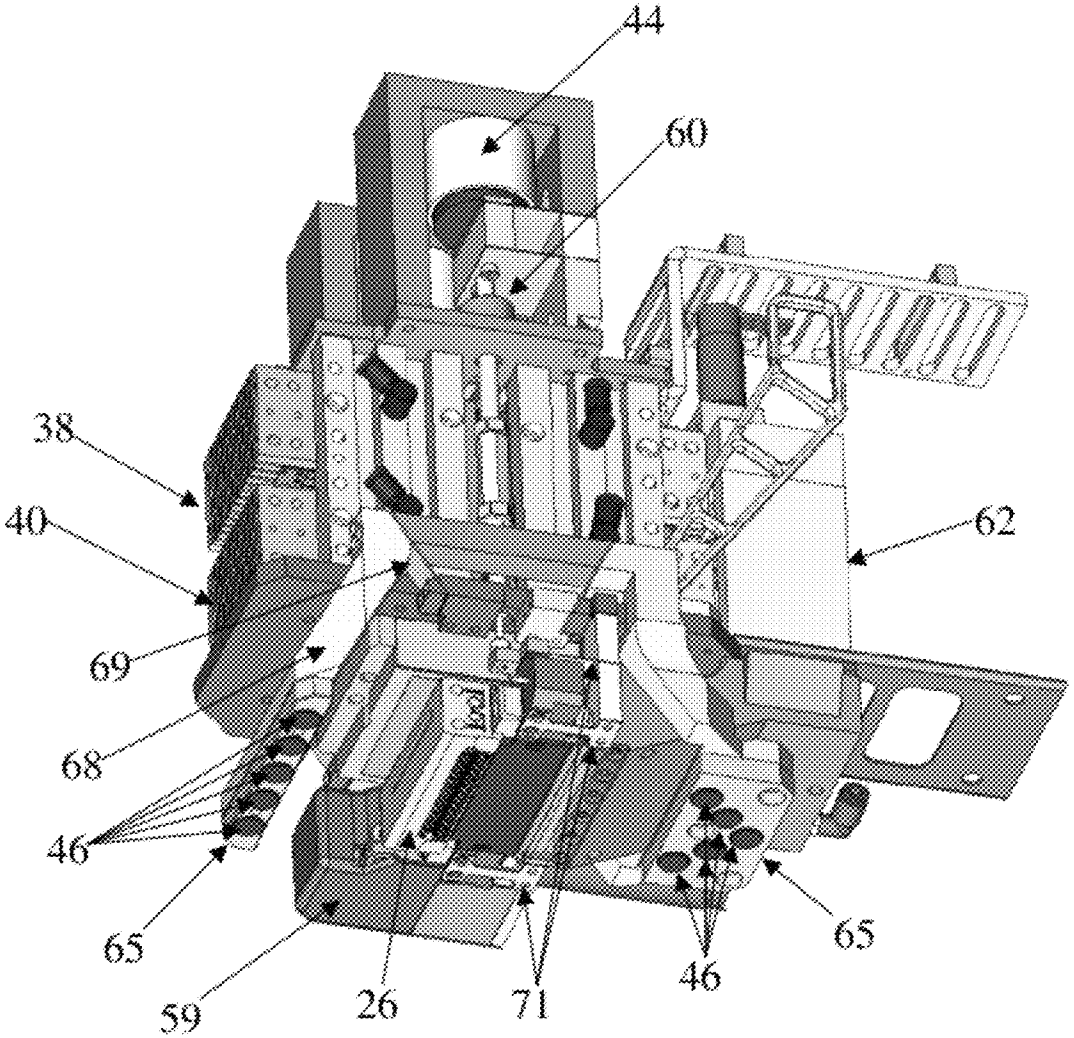

FIG. 9C is an isometric projection of the additional embodiment, in which, again, one of the row tool clamps 59 has been omitted. FIG. 9C illustrates the possible relative locations of the flag actuator assemblies 38 and 40, the wear pad assembly block 65, the wear pad assembly frame 68, the wedge flexure 69, the wedge actuator assembly 62, the voice coil actuators 44 (there are two), and the parallelogram flexures 71. The purpose of the parallelogram flexures 71 is to facilitate the applied pressure from the flag actuators and maintain parallelism of motion independent of the forces applied.

Figure 9D:
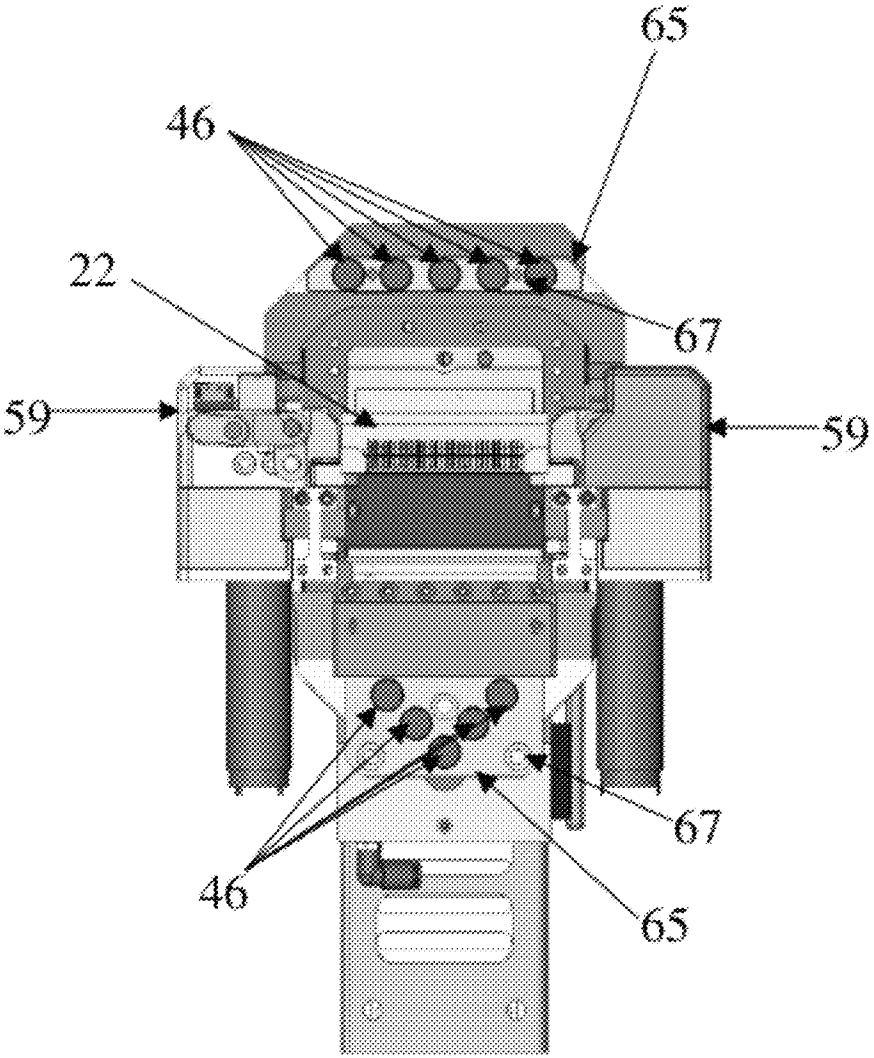

FIG. 9D is an orthographic projection of the bottom of the additional embodiment. The purpose of this figure is to illustrate the size and manner in which the wear pad assemblies are used, as well as a possible method of attachment for the wear pad assemblies. The wear pad assemblies 46 are mounted to a wear pad assembly block 65, which in turn is then mounted to the wear pad assembly frame 68 via the mount points 67 as illustrated in the figure. This allows for easy removal and replacement of the wear pad assemblies 46. It is also important to note the row tool clamps 59, both of which are now illustrated. The row tool clamp 59 on the left has had the cover removed to expose the method by which the row tool clamp 59 works.

Figure 10A:
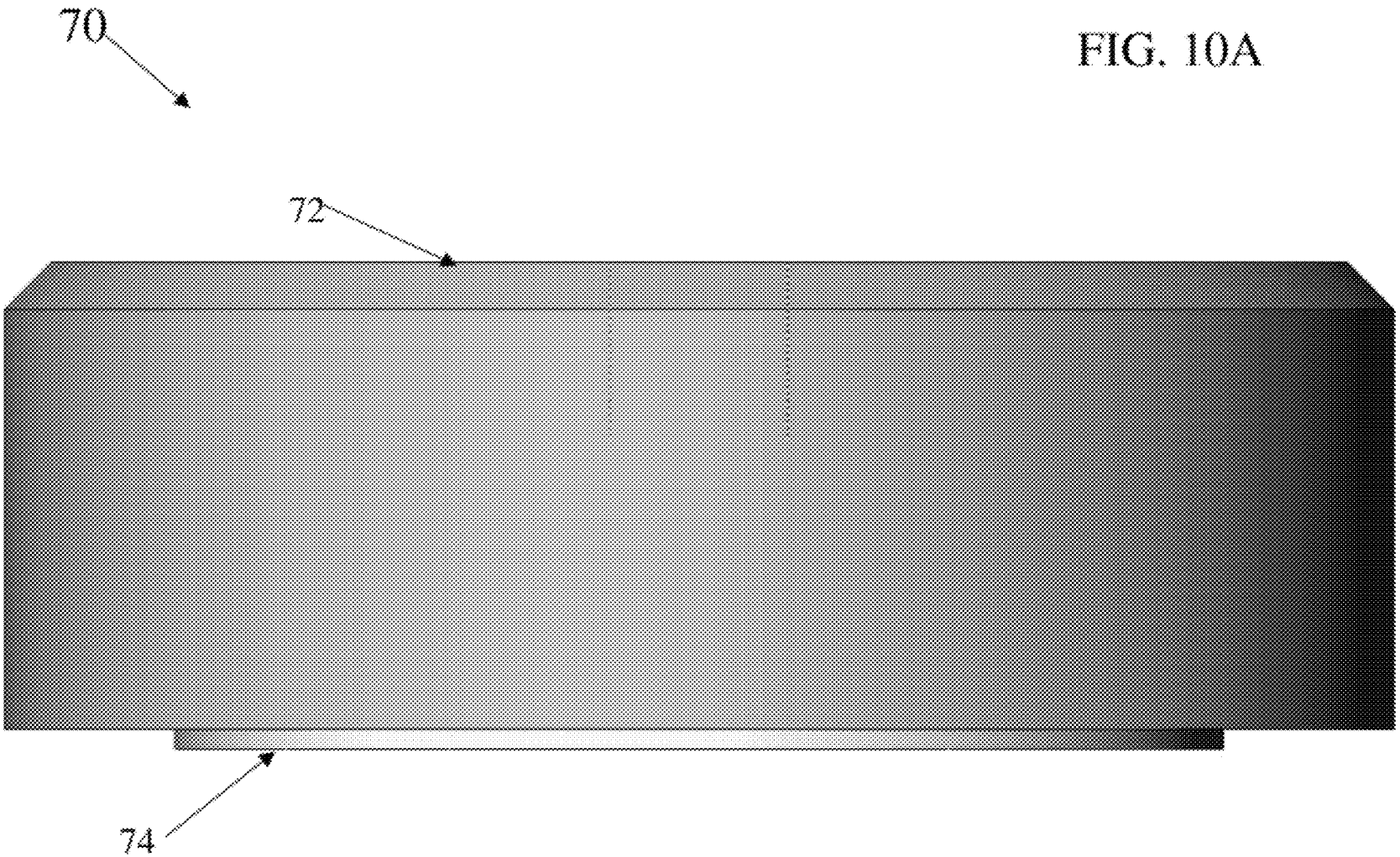
FIGS. 10A-C illustrates the porous media hydrostatic bearing assembly.
Figure 10B:
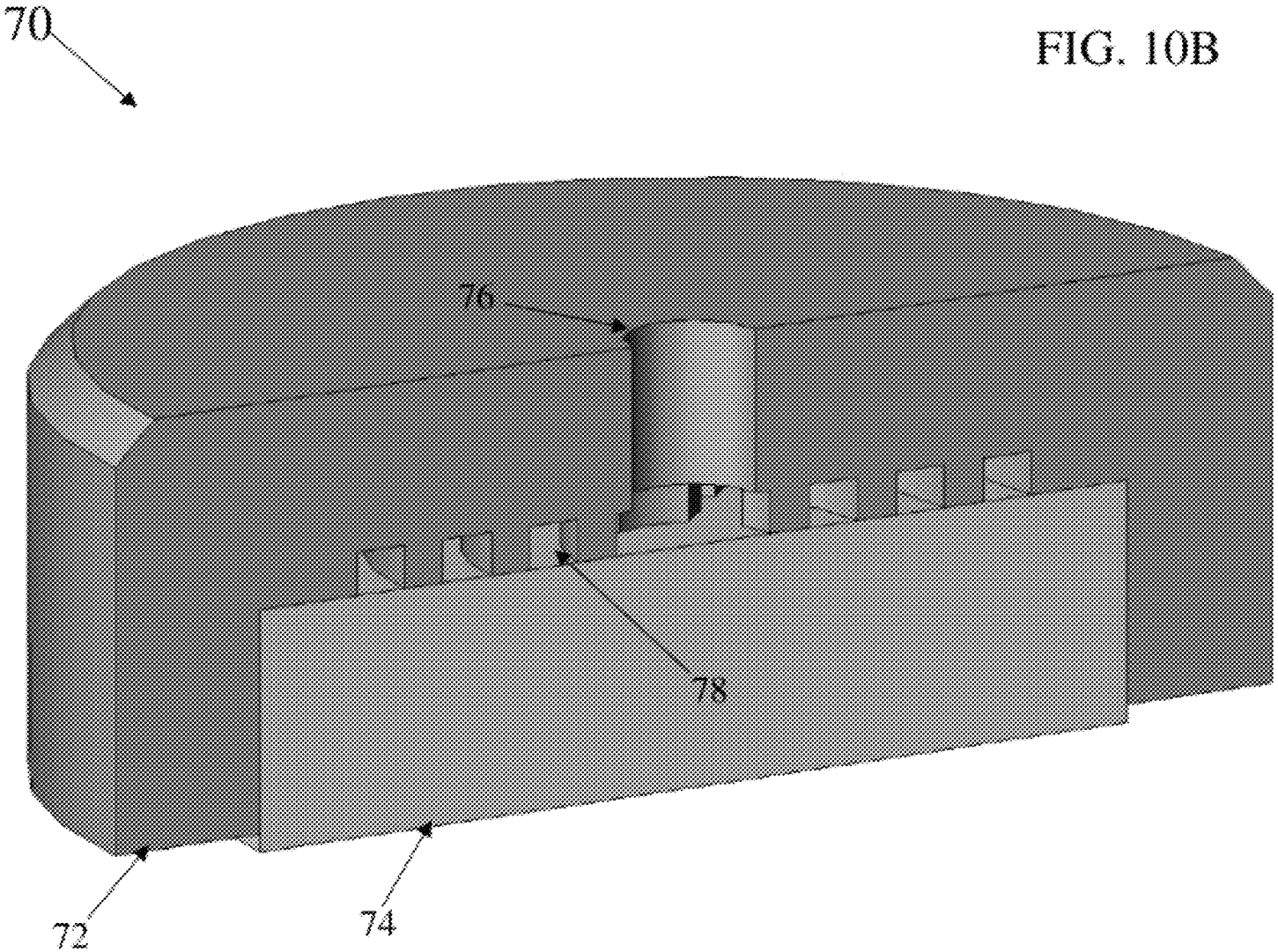
Figure 10C:
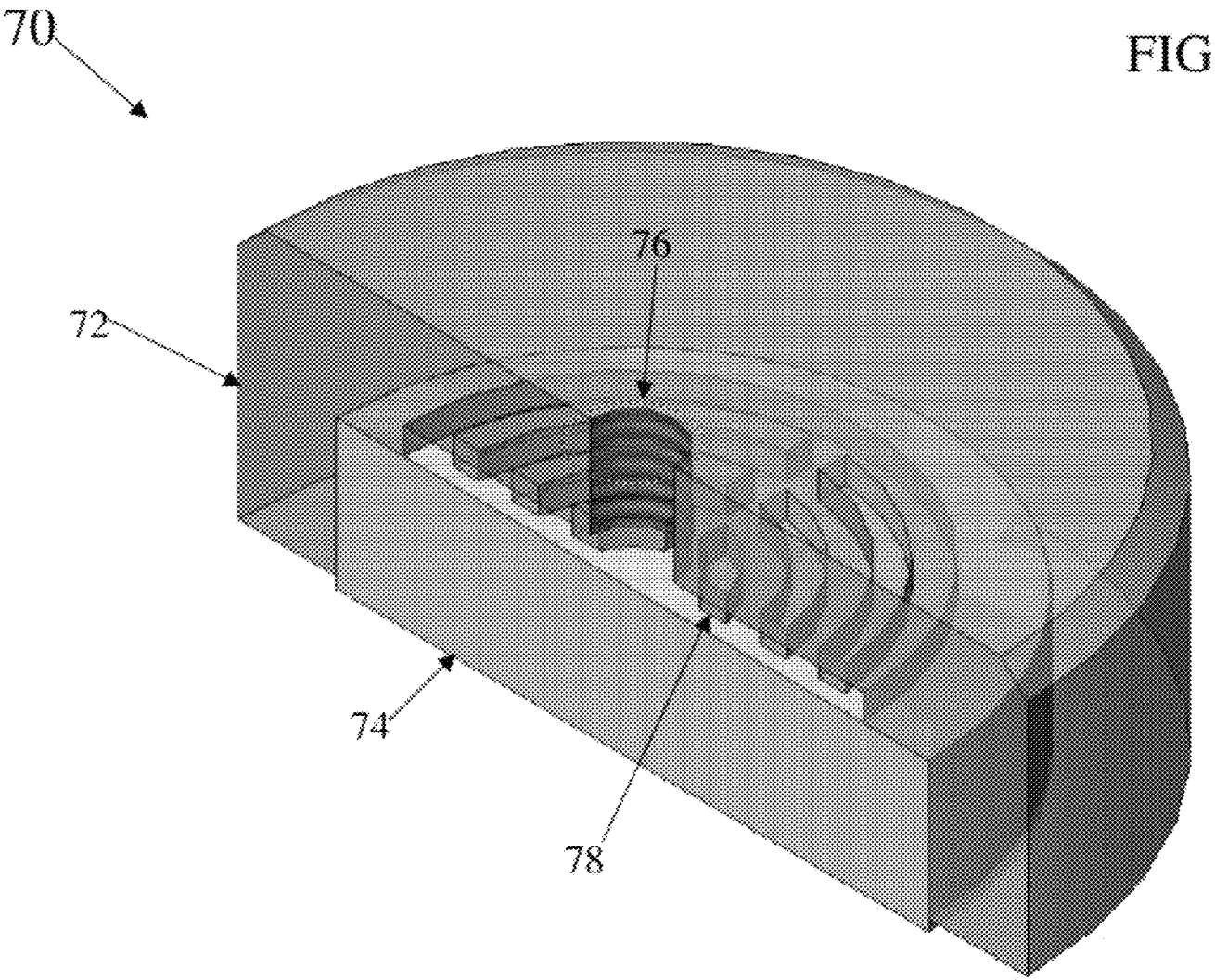

Referring now to FIGS. 10A-C, there are three views of the porous media wear pad assembly 70. As mentioned earlier another embodiment of the present invention could use a contact less, wear free load support. That load support can be in the form of a porous media wear pad assembly 70. The purpose of the porous media wear pad assembly 70 is to create a hydrostatic bearing surface between the lapping plate and the wear pad assembly. The benefits of a contact less load support is an elimination of the wear on the lapping plate normally associated with a standard wear par assembly. Also, the hydrostatic bearing surface would eliminate wear on the wear pads, thus creating a more stable reference datum location. An added benefit of a more stable reference datum location is a more accurate wedge adjustment. It should be noted that a hydrostatic bearing surface can be created by incorporating a porous media directly in what would have been the wear pad assembly block, and the porous media dose not have to be circular. In this case, wear pads would not be used. FIG. 10A is an orthographic projection of the side of a porous media wear pad assembly 70. A majority of the porous media wear pad is enclosed with in the wear pad housing 72. It should be noted that the media can be of any type of porous material, or any material capable of passing fluid, i.e. ceramic, graphite, plastic, and some metals, depending of the needs of the particular embodiment. FIG. 10B is a sectioned isometric side view of the porous media wear pad assembly 70. The purpose of this figure is to illustrate the fluid inlet throat 76, which leads to the fluid distribution channels 78. Note the location and proximity of the porous media wear pad 74 within in the wear pad enclosure 72, the purpose of the proximity is to ensure that the fluid that comes through the fluid inlet 76, and the fluid distribution channels 78, is evenly distributed throughout the porous media wear pad 74. FIG. 10C is an isometric sectioned view of the porous wear pad assembly 70. Again, note the manner in which the porous media wear pad 74 fits within the wear pad housing 72.

A lapping tool utilizing a fluid bearing may be controlled to float the bearings above the lapping plate, or to bring the bearings into light contact, with the fluid flow being controlled to bring the normal force of the bearing to a near zero value. The latter alternative was suggested by Drew Devitt of New Way Air Bearings, in his presentation entitled "Balanced Force Air Bearing" given to the ASPE at the 1999 annual conference, and included in the 1999 ASPE Proceedings.

In order for the control system to adjust the fluid supply to the fluid bearing to maintain a desired normal force, a feedback variable must be provided. In one embodiment, this feedback variable may be electrical conductivity between the bearing and the lapping plate. In the embodiment the bearing surface is made conductive so that conductivity to the lapping plate from the bearing is a measure of the extent of contact between the bearing surface and lapping plate. In such an embodiment, the control system measures electrical connectivity between the fluid bearing and the lapping plate, e.g. as a resistance, and feedback controls the fluid supply to the bearing to control the normal force of the fluid bearing to a near zero value by controlling the connectivity to desired setpoint, the fluid force being reduced in order to increase connectivity and the fluid force being increased to reduce connectivity.

Figure 11:
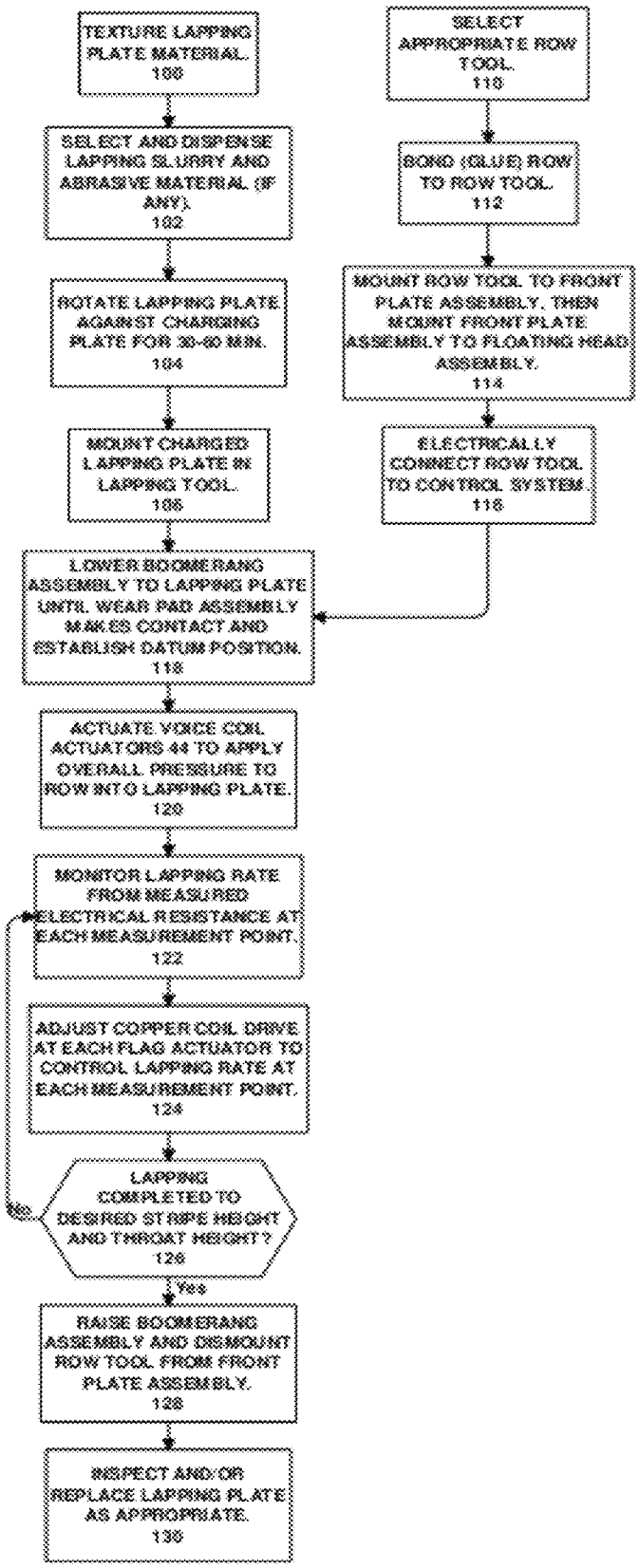
FIG. 11 is a flow chart of the process for lapping according to principles of the present invention.

Referring now to FIG. 11, a flow chart of the process of the present invention is illustrated. Steps 100-106 reference the preparation of the lapping plate. An appropriate row tool 22 should be selected 110. For the purpose of this description ceramic and stainless steel row tools 22 will be described, it should be noted that the row tool can be made of any number of different materials depending on the type of row 26 used, or the relative stiffness of the material as it relates to the number of pressure points. The row 26 will then be bonded to the row tool 22 using an adhesive consistent with the needs of the particular embodiment. It should be noted that the means by which the row 26 is attached to the row tool 22 could vary depending on the needs of the particular embodiment, i.e. screws, clamps and/or adhesive. The row tool 22 is then attached to the front plate assembly 20, which, in turn, is attached to the floating head assembly 14. Again, the method of attachment can take on a variety of different forms depending on the need of the particular embodiment. In step 116 the row tool 22 is electrically attached to a control system. Typically wires are bonded to the electrical contacts on the rowbar. This is done so as to determine the resistance values at different locations on the row 26 thus instructing the flag actuators to apply the correct pressure to specific points on the row 26. At step 118 the boomerang assembly 16 and all assemblies attach therein are lowered on to the lapping plate. The wear pad assemblies 46 make contact with the lapping plate and help determine a datum reference location. Once the datum is established the rowbar is rotated to achieve the desired wedge angle. Once the datum reference location has been established the voice coil actuators 44 contained in the fixed head assembly 12 apply an overall pressure 120 to the row tool 118. As described above the lapping rate at specified points along the row 26 is determined 122 by measuring resistance values at points along the row 26. At step 124 the resistance values determine the adjustment of the individual copper coils 56 that reside within the individual flag actuators. It is at this point that pressure can be applied to a specific point on the row 26 based on the previously determined resistance values. The stripe height and throat height are determined 126, if the desired height has been achieved then the process continues to step 128, however, if the desired height has not been achieved then the process returns to step 122 where a resistance measurement is again taken to determine necessary pressure. The boomerang assembly 16 is then raised from the lapping plate 128, and the row tool is removed from the front plate assembly 20. At step 130 the lapping plate is inspected and replaced if needed. In addition to the applied pressure, the wedge angle can also be continually adjusted to ensure that strip and throat heights are simultaneously achieved.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A lapping tool for lapping a substrate section, comprising:

a row tool to which the substrate section may be mounted, a lapping plate, a head to which the row tool is mounted, an actuator in the head for generating bending force, a force multiplier coupled between the actuator and a portion of the row tool, for multiplying the bending force generated by said actuator for application to said portion of the row tool.

2. The lapping tool of claim 1 wherein said force multiplier comprises a lever coupled between said actuator and said portion of said row tool.

3. The lapping tool of claim 1 wherein said actuator comprises a first magnetic voice coil and a first permanent magnet, the tool comprising a controller for delivering electric current to said first voice coil to magnetize said first voice coil and create magnetic forces between said first voice coil and said first permanent magnet.

4. The lapping tool of claim 3 wherein said actuator comprises a second magnetic voice coil and a second permanent magnet, the controller delivering electric current to said second voice coil to magnetize said second voice coil and create magnetic forces between said second voice coil and said second permanent magnet, the controller synchronizing force delivery by both voice coils to bend said portion of said row tool in a desired manner.

5. The lapping tool of claim 1 wherein said row tool is made of a material having a greater elastic modulus than stainless steel.

6. The lapping tool of claim 5 wherein said row tool is made of ceramic.

7. The lapping tool of claim 5 further comprising a substrate section mounted to said row tool, wherein said row tool is made of a material having a coefficient of thermal expansion that is substantially similar to that of the substrate section.

8. A lapping tool for lapping a substrate section, comprising:

a row tool to which the substrate section may be mounted, a lapping plate, a head to which the row tool is mounted, an actuator in the head for generating bending force applied to a portion of the row tool, the actuator comprising respective first and second magnetic voice coils and respective first and second permanent magnets, the tool comprising a controller for delivering electric current to said voice coils to magnetize said voice coils and create magnetic forces between said respective voice coils and permanent magnets.

9. The lapping tool of claim 8 wherein said controller synchronizes force delivery by both voice coils to bend said portion of said row tool in a desired manner.

10. The lapping tool of claim 8, further comprising a force multiplier coupled between said actuator and said portion of the row tool, for multiplying bending force generated by said actuator for application to said portion of the row tool.

11. The lapping tool of claim 10 wherein said force multiplier comprises a lever coupled between said actuator and said portion of said row tool.

12. The lapping tool of claim 11 wherein said row tool is made of a material having a greater elastic modulus than stainless steel.

13. The lapping tool of claim 11 wherein said row tool is made of ceramic.

14. The lapping tool of claim 8 further comprising a substrate section mounted to said row tool, wherein said row tool is made of a material having a coefficient of thermal expansion that is substantially similar to that of the substrate section.

15. A lapping tool for lapping a substrate section, comprising:

a row tool having a substrate section mounted thereto, a lapping plate, a head to which the row tool is mounted, an actuator in the head for generating bending force applied to a portion of the row tool, wherein the row tool comprises a material with a coefficient of thermal expansion that is substantially similar to that of the substrate section.

16. The lapping tool of claim 15 wherein said actuator comprises respective first and second magnetic voice coils and respective first and second permanent magnets, the tool comprising a controller for delivering electric current to said voice coils to magnetize said voice coils and create magnetic forces between said respective voice coils and permanent magnets.

17. The lapping tool of claim 16 wherein said controller synchronizes force delivery by both voice coils to bend said portion of said row tool in a desired manner.

18. The lapping tool of claim 15, further comprising a force multiplier coupled between said actuator and said portion of the row tool, for multiplying bending force generated by said actuator for application to said portion of the row tool.

19. The lapping tool of claim 18 wherein said force multiplier comprises a lever coupled between said actuator and said portion of said row tool.

20. The lapping tool of claim 15 wherein said row tool is made of a material having a greater elastic modulus than stainless steel.

21. The lapping tool of claim 20 wherein said row tool is made of ceramic.

22. A lapping tool for lapping a substrate section, comprising a row tool having a substrate section mounted thereto, a head to which the row tool is mounted, a plurality of actuators in the head for generating bending force applied to a portion of the row tool, a plurality of load cells each respectively positioned between a respective actuator and the row tool, measuring force applied by each respective actuator.

23. The lapping tool of claim 22 wherein the load cell is a strain gauge.

24. The lapping tool of claim 22 wherein the actuators comprise voice coils.

25. The lapping tool of claim 24 wherein the actuators apply force to the row tool at two locations thereof so as to control the lapping rate across the row bar.

* * * * *